US010882315B2

(12) United States Patent
Hizawa et al.

(10) Patent No.: US 10,882,315 B2
(45) Date of Patent: Jan. 5, 2021

(54) LIQUID EJECTING APPARATUS

(71) Applicant: SEIKO EPSON CORPORATION, Tokyo (JP)

(72) Inventors: Shunichi Hizawa, Matsumoto (JP); Satoshi Inomata, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/394,604

(22) Filed: Apr. 25, 2019

(65) Prior Publication Data

US 2019/0329548 A1 Oct. 31, 2019

(30) Foreign Application Priority Data

Apr. 27, 2018 (JP) ..... 2018-086431
Apr. 27, 2018 (JP) ..... 2018-086432

(51) Int. Cl.
*B41J 2/14* (2006.01)
*B41J 2/175* (2006.01)
*B41J 2/045* (2006.01)

(52) U.S. Cl.
CPC ..... *B41J 2/14* (2013.01); *B41J 2/04501* (2013.01); *B41J 2/175* (2013.01)

(58) Field of Classification Search
None
See application file for complete search history.

(56) References Cited

U.S. PATENT DOCUMENTS 6,467,869 B1 * 10/2002 Merz ..... B41J 2/1752 347/19
6,647,869 B2 * 11/2003 Bornhorst ..... B30B 1/263 100/257
2002/0039124 A1 * 4/2002 Nanjo ..... B41J 2/1752 347/49
2004/0091803 A1 * 5/2004 Yamazaki ..... G03G 9/09725 430/108.1
2008/0278530 A1 * 11/2008 Tanaka ..... B41J 2/17566 347/14

(Continued)

FOREIGN PATENT DOCUMENTS

JP 2007-076263 A 3/2007
JP 2008-149587 A 7/2008

(Continued)

*Primary Examiner* — Erica S Lin
*Assistant Examiner* — Tracey M McMillion
(74) *Attorney, Agent, or Firm* — Workman Nydegger

(57) ABSTRACT

A liquid ejecting apparatus includes a liquid ejecting portion that performs printing by ejecting a liquid to a medium from a plurality of nozzles, a first mounting portion that is configured to mount a first liquid container that contains the liquid, a second mounting portion that is configured to mount a second liquid container having a liquid containing amount smaller than a liquid containing amount of the first liquid container, a detecting portion that detects a remaining amount of the liquid contained in the first liquid container mounted in the first mounting portion, and a control portion that calculates a remaining amount of the liquid contained in the second liquid container, based on a standard value representing an amount of the liquid contained in the second liquid container and a standard value representing an ejection amount of the liquid ejected from the liquid ejecting portion.

13 Claims, 7 Drawing Sheets

(56) References Cited

U.S. PATENT DOCUMENTS

| | | | | |
|---|---|---|---|---|
| 2016/0375692 | A1* | 12/2016 | Qin | B41J 2/17546<br>347/7 |
| 2017/0063646 | A1* | 3/2017 | Kawai | G06Q 10/10 |
| 2017/0190186 | A1* | 7/2017 | Kubota | B41J 2/17503 |
| 2017/0297345 | A1* | 10/2017 | Usui | B41J 2/17546 |
| 2018/0072067 | A1* | 3/2018 | Kanaya | B41J 2/17553 |

FOREIGN PATENT DOCUMENTS

| | | | | |
|---|---|---|---|---|
| JP | 2012106388 | A * | 6/2012 | B41J 2/15 |
| JP | 2013-121710 | A | 6/2013 | |
| JP | 2014-104607 | A | 6/2014 | |

* cited by examiner

LIQUID EJECTING APPARATUS

The present application is based on, and claims priorities from JP Application Serial Number 2018-086431, filed Apr. 27, 2018 and JP Application Serial Number 2018-086432, filed Apr. 27, 2018, the disclosures of which are hereby incorporated by references herein in their entirety.

BACKGROUND

1. Technical Field

The present disclosure relates to a liquid ejecting apparatus such as an ink jet type printer, for example.

2. Related Art

JP-A-2008-149587 discloses a printer that calculates the remaining amount of a liquid by adding the amount of the liquid consumed by a printing operation, a flushing operation, a filling operation, a cleaning operation, and the like, as an example of a liquid ejecting apparatus.

In such a printer, the amount of the liquid consumed in practice varies. Therefore, a difference easily occurs between the calculated remaining amount of the liquid and the practical remaining amount of the liquid. Regarding this point, if a detecting portion, such as a sensor, that detects the remaining amount of the liquid is provided, it is possible to recognize the remaining amount of the liquid with high accuracy. However, the configuration becomes complicated.

SUMMARY

An advantage of some aspect of the disclosure is to provide a liquid ejecting apparatus capable of reducing an error of the remaining amount of a liquid with a simple configuration.

According to an aspect of the present disclosure, a liquid ejecting apparatus includes a liquid ejecting portion that performs printing by ejecting a liquid to a medium from a plurality of nozzles, a first mounting portion that is configured to mount a first liquid container that contains the liquid, a second mounting portion that is configured to mount a second liquid container having a liquid containing amount smaller than a liquid containing amount of the first liquid container, a detecting portion that detects a remaining amount of the liquid contained in the first liquid container mounted in the first mounting portion, and a control portion that calculates a remaining amount of the liquid contained in the second liquid container, based on a standard value representing an amount of the liquid contained in the second liquid container and a standard value representing an ejection amount of the liquid ejected from the liquid ejecting portion.

DESCRIPTION OF EXEMPLARY EMBODIMENTS

Hereinafter, embodiments of a liquid ejecting apparatus will be described with reference to the drawings. For example, the liquid ejecting apparatus is an ink jet type printer that prints an image of characters, pictures, or the like by ejecting an ink as an example of a liquid, to a medium such as paper.

First Embodiment

Figure 1:
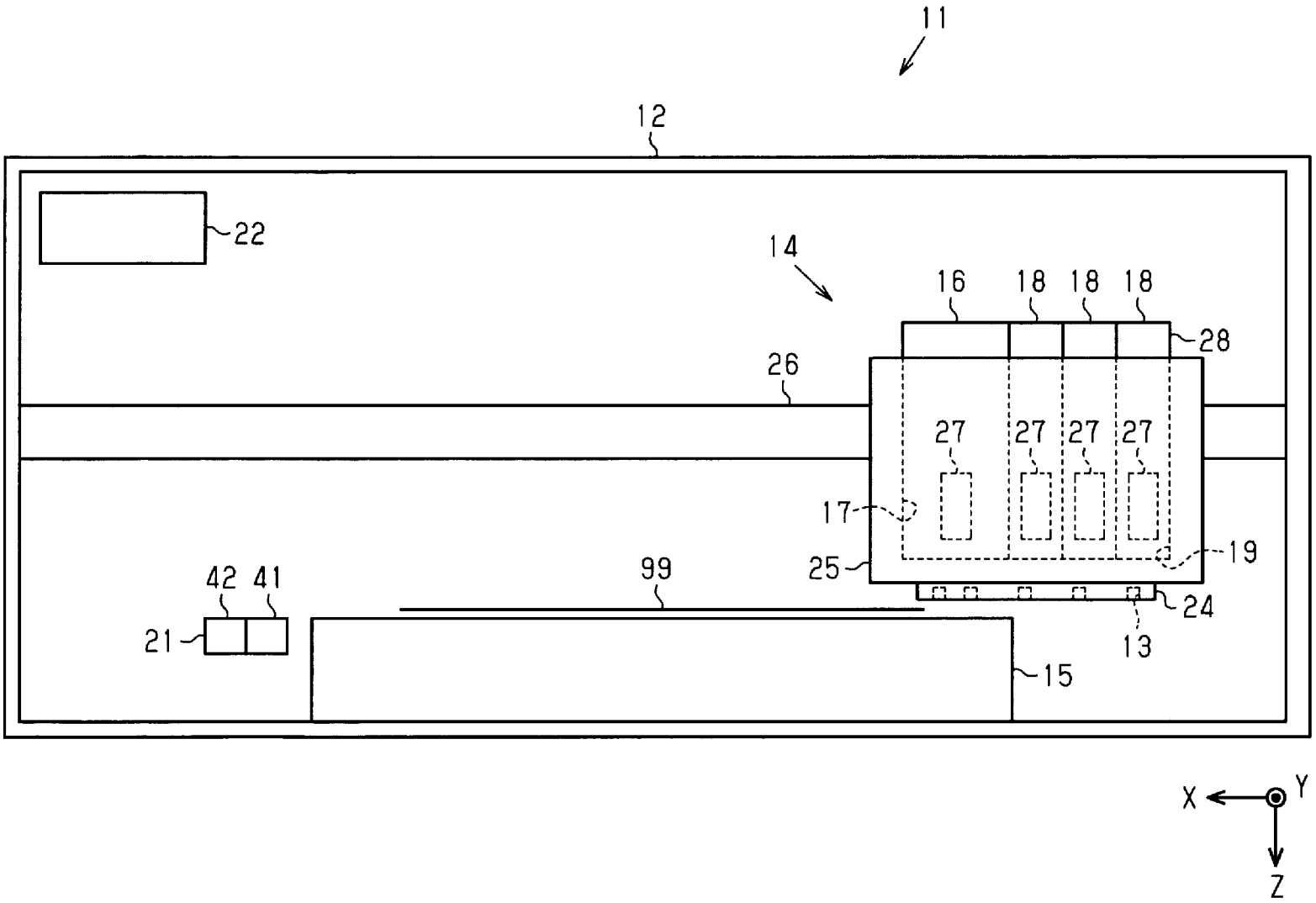
FIG. 1 is a front view schematically illustrating a liquid ejecting apparatus according to a first embodiment.

As illustrated in FIG. 1, a liquid ejecting apparatus 11 includes a housing 12. The liquid ejecting apparatus 11 includes a liquid ejecting portion 14 and a support base 15. The liquid ejecting portion 14 performs printing by ejecting a liquid to a medium 99 from a plurality of nozzles 13. The support base 15 supports the medium 99. The liquid ejecting apparatus 11 includes a first mounting portion 17 and a second mounting portion 19. The first mounting portion 17 is capable of mounting a first liquid container 16 that contains a liquid, therein. The second mounting portion 19 is capable of mounting a second liquid container 18 that contains a liquid. The liquid ejecting apparatus 11 includes a detecting portion 21 and a control portion 22. The detecting portion 21 detects the remaining amount of the liquid contained in the first liquid container 16 mounted in the first mounting portion 17. The control portion 22 collectively controls the entirety of the apparatus. For example, the control portion 22 controls the liquid ejecting portion 14 and the detecting portion 21. The control portion 22 is configured with a CPU, a memory, and the like.

The liquid ejecting portion 14 includes a head 24 having a plurality of nozzles 13, a carriage 25 in which the head 24 is mounted, and a guide shaft 26 that supports the carriage 25. The carriage 25 is allowed to move along the guide shaft 26. The head 24 ejects a liquid to the medium 99 supported by the support base 15, with scanning along with the carriage 25, and thereby prints an image on the medium 99. Therefore, the guide shaft 26 extends in a main scanning direction X which is a direction in which the head 24 performs scanning, in the liquid ejecting apparatus 11. In the embodiment, a position on the right end in the main scanning direction X in FIG. 1 is set as a home position of the carriage 25. When being in a standby state of not performing printing on the medium 99, the carriage 25 waits at the home position. The medium 99 supported by the support base 15 is transported on the support base 15 in a sub-scanning direction Y which is a direction different from the main scanning direction X and a vertical direction Z.

The liquid ejecting portion 14 receives liquids supplied from the first liquid container 16 mounted in the first mounting portion 17 and the second liquid container 18 mounted in the second mounting portion 19. The first liquid container 16 and the second liquid container 18 contain liquids of types different from each other. The first liquid container 16 and the second liquid container 18 are ink cartridges, for example. The first liquid container 16 and the second liquid container 18 contain dye inks, for example.

In the embodiment, the first mounting portion 17 and the second mounting portion 19 are provided in the liquid ejecting portion 14. Specifically, the first mounting portion 17 and the second mounting portion 19 are provided in the carriage 25. Therefore, the first liquid container 16 and the second liquid container 18 that contain liquids are mounted in the carriage 25 by being mounted in the first mounting portion 17 and the second mounting portion 19.

In the embodiment, the liquid ejecting apparatus 11 is a so-called on-carriage type in which the first liquid container 16 and the second liquid container 18 are mounted in the carriage 25. The liquid ejecting apparatus 11 may be an off-carriage type in which the first liquid container 16 and the second liquid container 18 are not mounted in the carriage 25. That is, the first mounting portion 17 and the second mounting portion 19 may not be provided in the carriage 25. In this case, the first liquid container 16 mounted in the first mounting portion 17 and the second liquid container 18 mounted in the second mounting portion 19 are coupled to the head 24 through a tube, for example.

The first liquid container 16 and the second liquid container 18 have a storage unit 27 that stores information regarding the liquid to be contained. The storage unit 27 in the first liquid container 16 stores a standard value representing the amount of the liquid contained in the first liquid container 16. The storage unit 27 in the second liquid container 18 stores a standard value representing the amount of the liquid contained by the second liquid container 18. When the first liquid container 16 and the second liquid container 18 are shipped, the storage unit 27 stores a standard value representing an initial remaining amount of the liquid contained in the corresponding liquid container.

The storage unit 27 in the first liquid container 16 is electrically coupled to the control portion 22 in a manner that the first liquid container 16 is mounted in the first mounting portion 17. The storage unit 27 in the second liquid container 18 is electrically coupled to the control portion 22 in a manner that the second liquid container 18 is mounted in the second mounting portion 19. The control portion 22 reads information from the storage unit 27 and writes information in the storage unit 27.

The second mounting portion 19 is capable of mounting the second liquid container 18 therein. The second liquid container 18 has a liquid containing amount is smaller than a liquid containing amount of the first liquid container 16. That is, the first mounting portion 17 is capable of mounting a liquid container having capacity larger than that of the second mounting portion 19, therein. Therefore, the initial remaining amount of the liquid contained in the first liquid container 16 is greater than the initial remaining amount of the liquid contained in the second liquid container 18.

A plurality of second liquid containers 18 may be mounted in the second mounting portion 19. The second mounting portion 19 is preferably configured to be capable of mounting of an integrated type second liquid container 28 in which the plurality of second liquid containers 18 is integrally formed. If the second mounting portion is configured to be capable of mounting of an integrated type second liquid container, the configuration of the second mounting portion 19 can be simplified in comparison to a configuration in which the plurality of second liquid containers 18 which is independent from each other is allowed to be mounted. Further, the plurality of second liquid containers 18 all together can be replaced with an integrated type second liquid container 28. A plurality of second mounting portions 19 may be provided. In this case, the second liquid containers 18 are mounted in the plurality of second mounting portions 19, respectively. Thus, the second liquid container 18 can be replaced, separately.

The detecting portion 21 is located to be adjacent to the support base 15 in the main scanning direction X. In the embodiment, the detecting portion 21 is located closer to the left end which is opposite to the side on which the home position is located, in the main scanning direction X. When the carriage 25 moving in the main scanning direction X is located just above the detecting portion 21, the detecting portion 21 detects the remaining amount of the liquid contained in the first liquid container 16. The detecting portion 21 may be provided in the support base 15.

In the embodiment, the first mounting portion 17 and the second mounting portion 19 are located to be arranged in the main scanning direction X. The first mounting portion 17 is located on an opposite side of the side on which the home position is located, in the main scanning direction X. That is, the second mounting portion 19 is located at a position close to the home position, in the main scanning direction X. The first mounting portion 17 is located at a position close to the detecting portion 21, in the main scanning direction X. With this arrangement, a distance between the first liquid container 16 mounted in the first mounting portion 17 and the detecting portion 21 in the main scanning direction X is reduced. Thus, it is possible to earlier detect the detecting portion 21 of the remaining amount of the liquid contained in the first liquid container 16.

Figure 2:
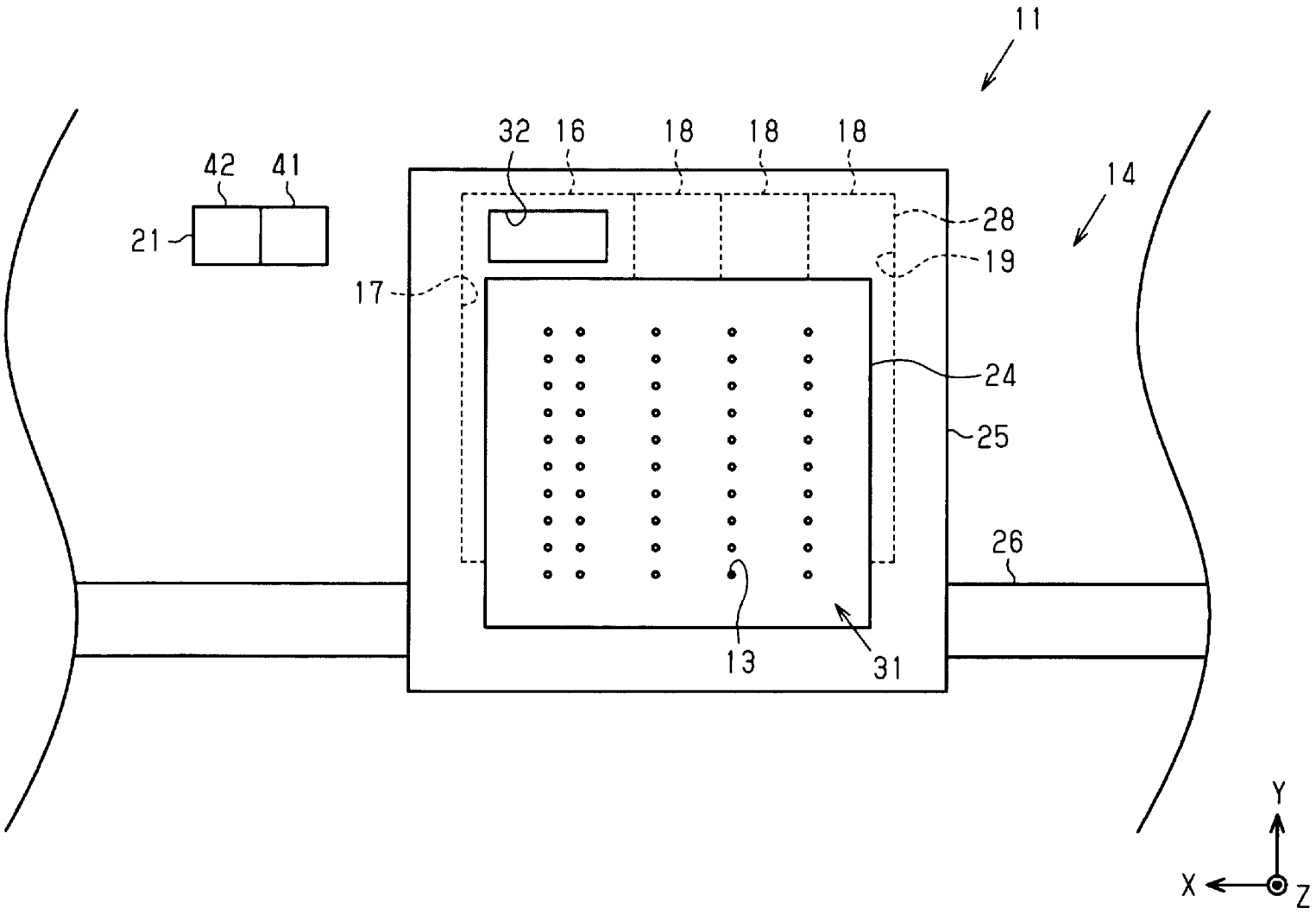
FIG. 2 is a bottom view illustrating a liquid ejecting portion.

As illustrated in FIG. 2, the head 24 includes a plurality of nozzle rows 31. The nozzle row is configured with a plurality of nozzles 13. In the embodiment, the nozzle row 31 is configured in a manner that the plurality of nozzles 13 is arranged in one line in the sub-scanning direction Y. The plurality of nozzle rows 31 are located in the head 24, so as to be arranged in the main scanning direction X. The plurality of nozzle rows 31 corresponds to the first liquid container 16 and the second liquid container 18 mounted in the first mounting portion 17 and the second mounting portion 19, respectively. That is, the liquid contained in the first liquid container 16 or the second liquid container 18 is ejected from the predetermined specific nozzle row 31.

The number of nozzles 13 corresponding to one second liquid container 18 is preferably smaller than the number of nozzles 13 corresponding to the first liquid container 16. If the number of nozzles 13 corresponding to one second liquid container 18 is set in the above manner, the ejection amount of the liquid which is ejected by the liquid ejecting portion 14 and is contained in the second liquid container 18 can be set to be smaller than the ejection amount of the liquid which is ejected by the liquid ejecting portion 14 and is contained in the first liquid container 16. That is, it is possible to suppress consumption of the liquid contained in the second liquid container 18 having a relatively small containment amount. Thus, it is possible to perform printing for a long term.

In the embodiment, the head 24 includes five nozzle rows 31. The number of nozzles 13 constituting one nozzle row 31 is equal to the number of nozzles 13 constituting another nozzle row 31. Two nozzle rows 31 located closer to the first mounting portion 17 among the five nozzle rows 31 arranged in the main scanning direction X correspond to the first liquid container 16. Other three nozzle rows 31 correspond to the three second liquid containers 18, respectively. The second liquid container 18 contains a color ink, for example. The three second liquid containers 18 contain a cyan ink, a magenta ink, and a yellow ink, respectively. The first liquid container 16 contains a black ink, for example.

The carriage 25 has a hole 32 for exposing a portion of the first liquid container 16 mounted in the first mounting portion 17. The hole 32 opens to communicate with the first mounting portion 17 from the lower surface of the carriage 25. When the detecting portion 21 detects the remaining amount of the liquid contained in the first liquid container 16, the carriage 25 is located at a position at which the hole 32 faces the detecting portion 21. The detecting portion 21 detects the remaining amount of the liquid contained in the first liquid container 16, through the hole 32.

Figure 3:
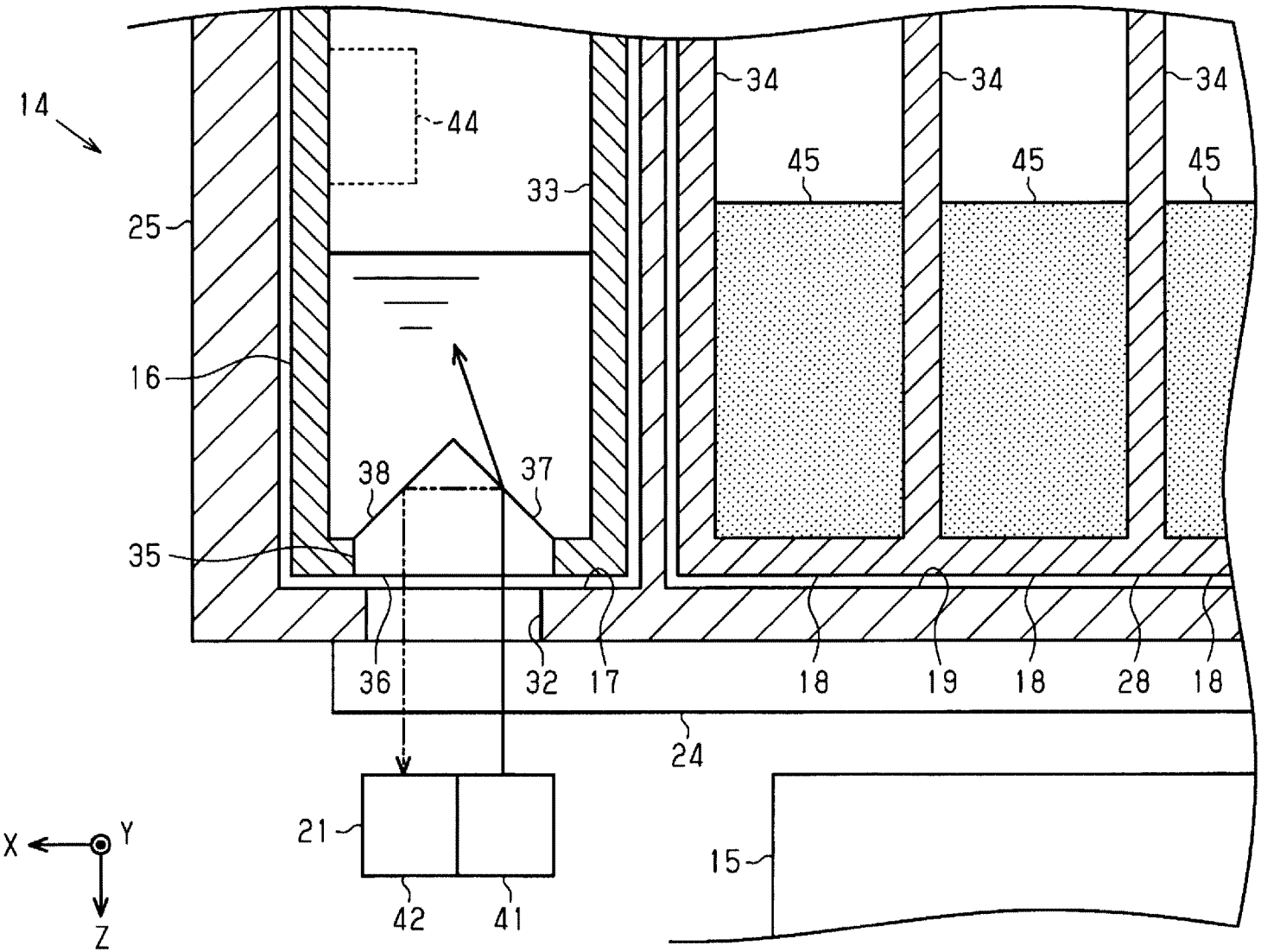
FIG. 3 is a sectional view illustrating the liquid ejecting portion.

As illustrated in FIG. 3, the first liquid container 16 includes a storage chamber 33 that contains the liquid. The second liquid container 18 includes a storage chamber 34 that contains the liquid. The volume of the storage chamber 33 of the first liquid container 16 is larger than the volume of the storage chamber 34 of the second liquid container 18. The first liquid container 16 includes a prism 35 used when the detecting portion 21 detects the remaining amount of the liquid contained in the storage chamber 33. When the first liquid container 16 has been mounted in the first mounting portion 17, the prism 35 is located to overlap the hole 32 in the vertical direction Z.

The prism 35 is a triangular prism, for example. The prism 35 has a first surface 36, a second surface 37, and a third surface 38. The first surface 36 constitutes a portion of the lower surface of the first liquid container 16. The second surface 37 and the third surface 38 constitute a portion of the inner surface of the storage chamber 33. The first surface 36 is a surface having a size in the main scanning direction X and the sub-scanning direction Y. In the embodiment, the first surface 36 is a horizontal surface. The second surface 37 and the third surface 38 are surfaces inclined from the first surface 36. When the liquid is sufficiently contained in the storage chamber 33, the second surface 37 and the third surface 38 come into contact with the liquid.

The detecting portion 21 includes a light emitting unit 41 that emits light and a light receiving unit 42 that receives light. The light emitting unit 41 and the light receiving unit 42 are located to be arranged in the main scanning direction X. When the detecting portion 21 detects the remaining amount of the liquid, the light emitting unit 41 emits light toward the prism 35. Light emitted by the light emitting unit 41 abuts on the prism 35 through the hole 32. The light abutting on the prism 35 penetrates the first surface 36 and is incident into the prism 35. The light incident into the prism 35 abuts on the second surface 37. At this time, a traveling direction of the light abutting on the second surface 37 changes depending on the amount of the liquid contained in the storage chamber 33.

When a portion on which the light abuts in the second surface 37 is in contact with the liquid, the light abutting on the second surface 37 is refracted by the second surface 37 and travels in the storage chamber 33, as illustrated with a solid line in FIG. 3. When the remaining amount of the liquid contained in the storage chamber 33 is sufficient, the light abutting on the second surface 37 is refracted by the second surface 37 and travels in the storage chamber 33 because a difference between the refractive index of the prism 35 and the refractive index of the liquid in the storage chamber 33 is small. As a result, when the remaining amount of the liquid is sufficient, most of light emitted by the light emitting unit 41 penetrates the prism 35. Therefore, when the remaining amount of the liquid is sufficient, the quantity of light received by the light receiving unit 42 is small.

When the portion on which the light abuts in the second surface 37 is not in contact with the liquid, the light abutting on the second surface 37 is reflected by the second surface 37 and travels in the prism 35, as illustrated with a two-dot chain line in FIG. 3. In a case where the remaining amount of the liquid contained in the storage chamber 33 is small, the light abutting on the second surface 37 is reflected by the second surface 37 and travels in the prism 35 because a difference between the refractive index of the prism 35 and the refractive index of an air in the storage chamber 33 is large.

The light reflected by the second surface 37 abuts on the third surface 38. The light abutting on the third surface 38 is reflected by the third surface 38 and travels in the prism 35 because the portion on which the light abuts in the third surface 38 is not in contact with the liquid. The light reflected by the third surface 38 is received by the light receiving unit 42. That is, when the remaining amount of the liquid contained in the storage chamber 33 is small, most of light emitted by the light emitting unit 41 is reflected by the prism 35. Therefore, when the remaining amount of the liquid is small, the amount of light received by the light receiving unit 42 is large. In this manner, in the embodiment, the detecting portion 21 is a reflective type optical sensor. The detecting portion 21 may be a transmission type optical sensor.

The detecting portion 21 outputs the amount of light received by the light receiving unit 42 to the control portion 22. The control portion 22 determines whether or not the remaining amount of the liquid contained in the first liquid container 16 is equal to or greater than a threshold, based on the amount of the light received by the light receiving unit 42. That is, the first liquid container 16 is a sensor-type liquid container in which the remaining amount of the liquid is detected by the detecting portion 21.

The control portion 22 determines whether or not the amount of the liquid received by the light receiving unit 42 is equal to or smaller than a predetermined value. The predetermined value may be stored in the control portion 22 or may be stored in the storage unit 27 of the first liquid container 16. When the amount of the received light is equal to or smaller than the predetermined value, the control portion 22 determines that the remaining amount of the liquid contained in the first liquid container 16 is sufficient. That is, the control portion 22 determines that the remaining amount of the liquid contained in the first liquid container 16 is equal to or greater than the threshold.

When the amount of the light received by the light receiving unit 42 is greater than the predetermined value, the control portion 22 determines that the remaining amount of the liquid contained in the first liquid container 16 is small. That is, the control portion 22 determines that the remaining amount of the liquid contained in the first liquid container 16 is smaller than the threshold. In this manner, in the embodiment, the detecting portion 21 detects the remaining amount of the liquid contained in the first liquid container 16, based on the amount of the light received by the light receiving unit 42, in an indirect manner. The threshold indicates the amount of the liquid expected to be necessary for continuous printing.

When the remaining amount of the liquid contained in the first liquid container 16 is smaller than the threshold, the control portion 22 may report that the remaining amount of the liquid is small. In this case, the control portion 22 performs a report, for example, via a liquid crystal screen of the liquid ejecting apparatus 11, and a computer which is electrically coupled to the liquid ejecting apparatus 11.

The detecting portion 21 may compare the amount of the light received by the light receiving unit 42 to the predetermined value. For example, the detecting portion 21 may output a signal having a high level when the amount of the received light is smaller than the predetermined value, to the control portion 22, and output a signal having a low level when the amount of the received light is equal to or greater than the predetermined value, to the control portion 22.

The detecting portion 21 may directly detect the remaining amount of the liquid. For example, the detecting portion 21 may detect the remaining amount of the liquid based on the weight of the first liquid container 16. The detecting portion 21 may be a capacitive sensor using an electrode or an ultrasonic sensor.

The control portion 22 calculates the remaining amount of the liquid contained in the second liquid container 18 based on a standard value representing the amount of the liquid contained in the second liquid container 18 and a standard value representing the ejection amount of the liquid ejected from the liquid ejecting portion 14. In this specification, the standard value representing the amount of the liquid contained in the second liquid container 18 is referred to as a first standard value. The standard value representing the ejection amount of the liquid ejected from the liquid ejecting portion 14 is referred to as a second standard value.

The first standard value is stored in the storage unit 27 of the second liquid container 18. The first standard value represents the remaining amount of the liquid which is currently contained by the second liquid container 18. The second standard value is calculated by the control portion 22. The control portion 22 calculates the second standard value representing the ejection amount of the liquid ejected from the liquid ejecting portion 14, by multiplying the ejection amount per ejection of the liquid ejecting portion 14 by the number of ejections. That is, the second standard value represents the amount of liquid consumed by the liquid ejecting portion 14 ejecting the liquid. The ejection amount per ejection of the liquid ejecting portion 14 is stored in the control portion 22.

When the liquid ejecting portion 14 ejects the liquid, the control portion 22 counts the number of ejections of the liquid ejecting portion 14. The control portion 22 calculates the second standard value from the counted number of ejections. The control portion 22 reads the first standard value from the storage unit 27 of the second liquid container 18. The control portion 22 calculates the remaining amount of the liquid contained in the second liquid container 18, by subtracting the second standard value from the first standard value. The control portion 22 writes the calculated remaining amount of the liquid, as the first standard value, in the storage unit 27 of the second liquid container 18. In the embodiment, the control portion 22 subtracts the amount of the consumed liquid from the remaining amount of the liquid contained in the second liquid container 18 before the liquid ejecting portion 14 ejects the liquid, and thereby calculates the remaining amount of the liquid contained in the second liquid container 18 after the liquid ejecting portion 14 ejects the liquid. The control portion 22 repeats this operation every time the liquid ejecting portion 14 ejects the liquid. That is, the second liquid container 18 is a count-type liquid container in which the remaining amount of the liquid is calculated by the control portion 22.

When calculating the remaining amount of the liquid contained in the second liquid container 18, the control portion 22 determines whether or not the remaining amount of the liquid is equal to or greater than a threshold. The threshold may be equal to or different from the threshold of the first liquid container 16. When the remaining amount of the liquid contained in the second liquid container 18 is smaller than the threshold, the control portion 22 may report that the remaining amount of the liquid is small.

The control portion 22 may calculate the remaining amount of the liquid contained in the second liquid container 18 by adding the amount of the consumed liquid every time the liquid ejecting portion 14 ejects the liquid. In this case, the control portion 22 adds the number of ejections of the liquid ejecting portion 14 when the liquid ejecting portion 14 ejects the liquid. The control portion 22 calculates the second standard value from the ejection amount per ejection and the added number of ejections. The control portion 22 calculates the remaining amount of the liquid contained in the second liquid container 18 by subtracting the second standard value from the first standard value.

Generally, the ejection amount per ejection varies when the liquid ejecting portion 14 ejects the liquid in practice. Therefore, the ejection amount per ejection of the liquid ejecting portion 14, which is stored in the control portion 22 differs from the ejection amount per ejection when the liquid ejecting portion 14 ejects the liquid in practice. Thus, the remaining amount of the liquid, which has been calculated by the control portion 22 easily differs from the practical remaining amount of the liquid. That is, an error easily occurs in the calculated remaining amount of the liquid in the count-type liquid container. The error in the calculated remaining amount of the liquid increases as the number of ejections of the liquid ejecting portion 14 that ejects the liquid increases. In the sensor-type liquid container, it is possible to recognize the remaining amount of the liquid by the detecting portion 21 with high accuracy, but the configuration required for recognizing the remaining amount of the liquid is complicated.

As the liquid containing amount in the liquid container increases, the number of ejections when the liquid ejecting portion 14 can continuously ejecting the liquid increases. That is, if the liquid container having a small liquid containing amount is set to a count-type, an error occurs small in the calculated remaining amount of the liquid. Therefore, the first liquid container 16 as a sensor-type liquid container having a relatively large liquid containing amount is allowed to be mounted in the first mounting portion 17. The second liquid container 18 as a count-type liquid container having a relatively small liquid containing amount is allowed to be mounted in the second mounting portion 19. If the first liquid container 16 and the second liquid container 18 are mounted in the first mounting portion 17 and the second mounting portion 19, respectively, it is possible to recognize the remaining amount of the liquid with a simple configuration, in comparison to a case where both the first liquid container 16 and the second liquid container 18 are sensor-type. It is possible to recognize the remaining amount of the liquid with high accuracy in comparison to a case where both the first liquid container 16 and the second liquid container 18 are count-type. That is, it is possible to suppress the error in the remaining amount of the liquid with a simple configuration.

Preferably, the control portion 22 allows the liquid ejecting portion 14 to perform printing until all liquids respectively contained in the plurality of second liquid containers 18 are smaller than the threshold. When the plurality of second liquid containers 18 is configured to be an integrated type second liquid container 28, separate replacement is not possible. For example, if the integrated type second liquid container 28 is replaced because a magenta ink becomes small even though a cyan ink remains sufficiently, the cyan ink which remains sufficiently is discarded. Therefore, the liquid is easily wasted when the second liquid container 18 is replaced. From this point, if printing of the liquid ejecting portion 14 is set to be capable of being continuously performed until all liquids respectively contained in the plurality of second liquid containers 18 are smaller than the threshold, it is possible to reduce waste of the liquid when the second liquid container 18 is replaced.

When the remaining amount of the liquid contained in the second liquid container 18 is smaller than the threshold, the control portion 22 preferably sets in a state where performing a monochrome mode is possible. In the monochrome mode, the liquid is ejected not from the nozzles 13 corresponding to the second liquid container 18 but from the nozzles 13 corresponding to the first liquid container 16. That is, the monochrome mode is a mode in which an image is printed by ejecting a black ink instead of a color ink. In this case, the image is printed in a monochromic state. If being performed in this manner, it is possible to perform printing for a long term without replacing the second liquid container 18. In the embodiment, the liquid ejecting apparatus 11 has a monochrome mode and a normal mode. The normal mode is a mode in which printing is performed in full color.

Preferably, the control portion 22 can calculate the remaining amount of the liquid contained in the first liquid container 16 based on the standard value representing the amount of the liquid contained in the first liquid container 16 and the standard value representing the ejection amount of the liquid ejected from the liquid ejecting portion 14. That is, the control portion 22 may calculate the remaining amount of the liquid contained in the first liquid container 16 in a manner similar to that for the second liquid container 18.

Preferably, the control portion 22 compares the calculated remaining amount of the liquid contained in the first liquid container 16 to the remaining amount of the liquid contained in the first liquid container 16, which has been detected by the detecting portion 21, and corrects the calculation result of the remaining amount of the liquid contained in the second liquid container 18 based on the comparison. If the remaining amount of the liquid, which has been detected by the detecting portion 21 and the remaining amount of the liquid, which has been calculated by the control portion 22 are compared to each other, a difference may occur between the two values. The reason is that the ejection amount of the liquid per ejection, which is ejected by the liquid ejecting portion 14 in practice varies.

The ejection amount of the liquid per ejection, which is ejected by the liquid ejecting portion 14 also varies depending on an individual difference of the head 24. Therefore, variation of the ejection amount per ejection of the nozzle 13 at which the liquid contained in the first liquid container 16 is ejected and variation of the ejection amount per ejection of the nozzle 13 at which the liquid contained in the second liquid container 18 has a relation.

If the remaining amount of the liquid contained in the first liquid container 16, which has been calculated by the control portion 22 is compared to the remaining amount of the liquid contained in the first liquid container 16, which has been detected by the detecting portion 21, it is possible to calculate a difference between the ejection amount per ejection of the liquid ejecting portion 14, which is stored by the control portion 22 and the practical ejection amount per ejection of the liquid ejecting portion 14, as the comparison result. If the remaining amount of the liquid contained by the second liquid container 18, which is a calculation result obtained by calculation of the control portion 22, is corrected based on the difference of the ejection amount as the comparison result, it is possible to reduce the error in the remaining amount of the liquid contained by the second liquid container 18.

The first liquid container 16 and the second liquid container 18 have a negative-pressure generation mechanism for setting the inside of the head 24 to negative pressure. It is possible to form a meniscus at a gas-liquid interface in the nozzle 13 if the inside of the head 24 is set to negative pressure by the negative-pressure generation mechanism. It is possible to desirably eject the liquid from the nozzle 13 by forming the meniscus.

The first liquid container 16 includes a differential pressure valve 44 as the negative-pressure generation mechanism. The differential pressure valve 44 is located in the middle of a flow path extending from the storage chamber 33 toward the head 24 in the first liquid container 16. The differential pressure valve 44 opens or closes based on a difference between pressure of the flow path on an upstream of the differential pressure valve 44 and pressure of the flow path on a downstream of the differential pressure valve 44. The flow path on the upstream of the differential pressure valve 44 is joined to the storage chamber 33. The flow path on the downstream of the differential pressure valve 44 is joined to the head 24. The pressure of the flow path on the upstream of the differential pressure valve 44 is larger than the pressure of the flow path on the upstream of the differential pressure valve 44. If the differential pressure valve 44 opens, the liquid contained in the storage chamber 33 is supplied to the head 24.

The differential pressure valve 44 is configured to close in a state where the inside of the head 24 has predetermined negative pressure. The differential pressure valve 44 opens when the negative pressure in the head 24 becomes larger than a predetermined value. If the head 24 ejects the liquid from the nozzle 13, the negative pressure in the head 24 increases. That is, the negative pressure of the flow path on the downstream of the differential pressure valve 44 increases. Thus, the differential pressure valve 44 opens. If the liquid is supplied into the head 24 by the differential pressure valve 44 opening, the negative pressure in the head 24 is reduced. If the negative pressure in the head 24 is reduced, the differential pressure valve 44 closes. In this manner, the differential pressure valve 44 supplies the liquid from the storage chamber 33 into the head 24 while adjusting the pressure in the head 24.

The differential pressure valve 44 may be configured to open or close based on a difference between atmospheric pressure and the pressure of the flow path on the downstream of the differential pressure valve 44, for example. A valve configured to close in a state where the inside of the storage chamber 33 is set to predetermined negative pressure may be employed as the negative-pressure generation mechanism of the first liquid container 16. In this case, since the storage chamber 33 has predetermined negative pressure, the inside of the head 24 joined to the storage chamber 33 also has the predetermined negative pressure. If the negative pressure in the head 24 increases, the value causes an air to flow into the storage chamber 33. Thus, the pressure in the head 24 is adjusted.

The second liquid container 18 includes a porous member 45 as the negative-pressure generation mechanism. The porous member 45 is a member in which a plurality of fine holes is provided. In the embodiment, the porous member 45 is non-woven fabric, for example. The porous member 45 is located in the storage chamber 34. The porous member 45 absorbs the liquid in the storage chamber 34. The storage chamber 34 becomes the predetermined negative pressure by an absorption force of the porous member 45. Since the storage chamber 34 has the predetermined negative pressure, the inside of the head 24 joined to the storage chamber 34 also has predetermined negative pressure. That is, the second mounting portion 19 is configured to allow mounting of the second liquid container 18 in which the porous member 45 is provided in the storage chamber 34 that contains the liquid.

The porous member 45 may have a function of being capable of holding the liquid. The porous member 45 may be a foam member such as urethane foam in addition to the non-woven fabric. The porous member 45 may be a fiber member obtained in a manner that synthetic resin such as polypropylene or polyethylene and pulp or the like are made in a fiber form and bundled. When the porous member 45 is employed as the negative-pressure generation mechanism, it is possible to simplify the configuration of the liquid container in comparison to a case of providing the differential pressure valve 44. When the differential pressure valve 44 is employed as the negative-pressure generation mechanism, it is possible to contain a pigment ink because the porous member 45 is not provided. In the liquid container including the porous member 45, the pigment component of the pigment ink is deposited in the porous member 45, and thus it is not preferable that the pigment ink is contained.

In the second liquid container 18 including the porous member 45, if the negative pressure in the head 24 is set to be equal to or larger than a predetermined value, the liquid held in the porous member 45 is sucked toward the head 24. In the second liquid container 18, if the negative pressure in the head 24 rapidly increases by the liquid ejecting portion 14 ejecting a large amount of the liquid, the liquid is strongly sucked from the porous member 45 toward the head 24. In this case, the liquid flows out from an area of the porous member 45, in which the liquid is easily sucked. Thus, the liquid is not uniformly sucked from the porous member 45. Therefore, if the remaining amount of the liquid in the storage chamber 34 is small, the air in the storage chamber 34 may be supplied into the head 24 along with the liquid.

Preferably, the control portion 22 reduces the ejection amount of the liquid ejected per unit time by the liquid ejecting portion 14, depending on that the remaining amount of the liquid contained in the second liquid container 18 is reduced. If the control portion 22 reduces the ejection amount, it is possible to suppress a rapid increase of the negative pressure in the head 24 and to reduce a concern of the liquid being strongly sucked from the second liquid container 18. Therefore, it is possible to suppress an occurrence of a supply of an air from the storage chamber 34 into the head 24. The ejection amount of the liquid ejected per unit time by the liquid ejecting portion 14 can be reduced, for example, by increasing the number of times of scanning of the carriage 25 with respect to the medium 99 in printing or by reducing a moving speed of the carriage 25.

The first liquid container 16 and the second liquid container 18 may not have the negative-pressure generation mechanism. In this case, the first liquid container 16 and the second liquid container 18 are disposed such that the height of a liquid surface in the storage chamber 33 and the height of a liquid surface in the storage chamber 34 are located to be lower than the height of a surface on which the nozzle 13 is formed in the head 24. If the heights are set in this manner, the inside of the head 24 has predetermined negative pressure by a water head difference.

Next, an operation of the liquid ejecting apparatus 11 will be described.

The liquid ejecting apparatus 11 performs remaining-amount determination processing, for example, at timings such as a timing in printing an image, a timing after printing ends, and a timing just after power is supplied. In the remaining-amount determination processing, it is determined whether the remaining amount of the liquid contained in the second liquid container 18 is large or small. When the remaining-amount determination processing is performed, it may be determined whether the remaining amount of the liquid contained in the first liquid container 16 is large or small.

Figure 4:
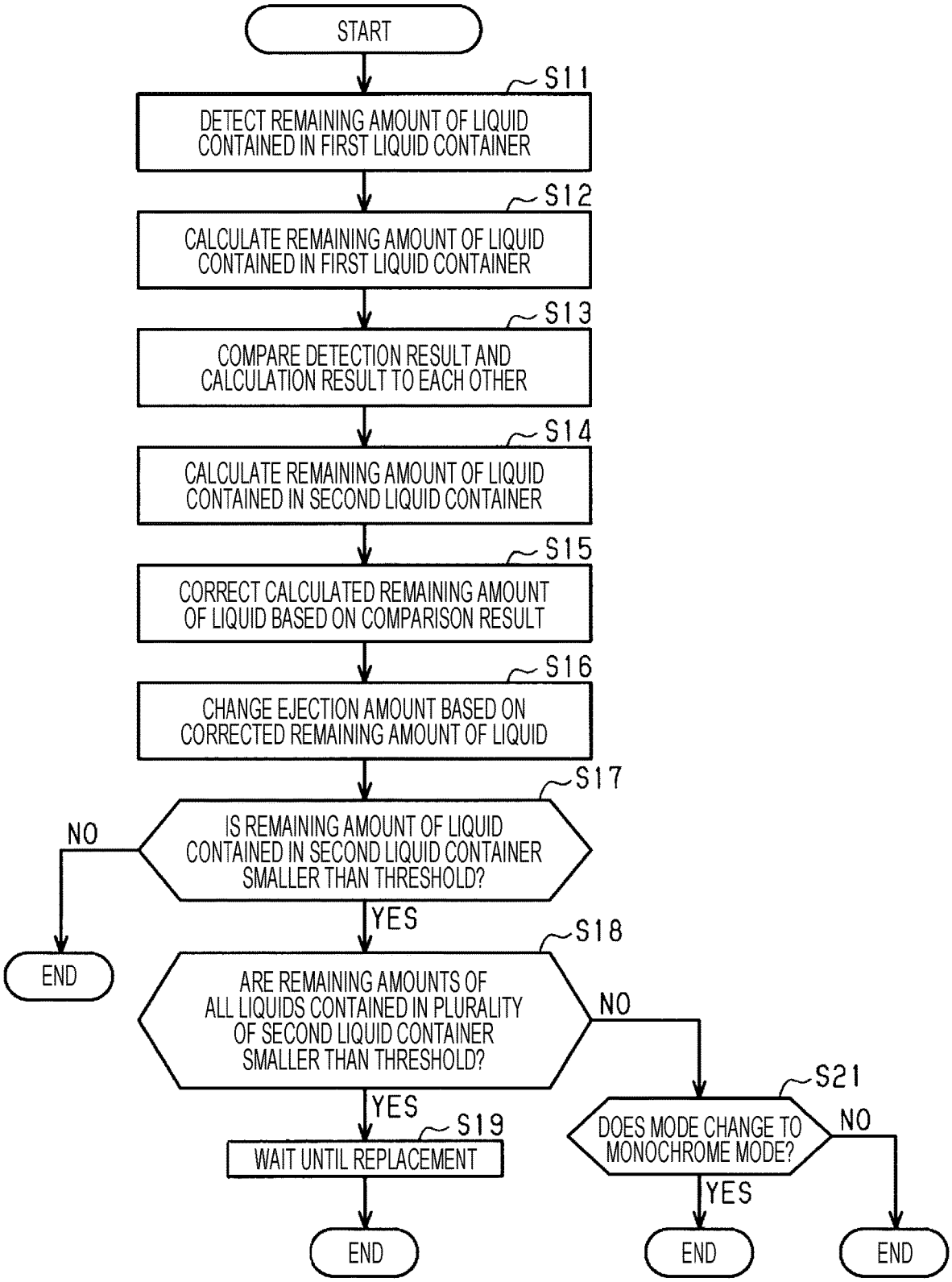
FIG. 4 is a flowchart illustrating a processing routine of remaining-amount determination processing.

As illustrated in FIG. 4, in Step S11, the control portion 22 that performs the remaining-amount determination processing controls the detecting portion 21 to detect the remaining amount of the liquid contained in the first liquid container 16. In Step S12, the control portion 22 calculates the remaining amount of the liquid contained in the first liquid container 16, based on a standard value. In Step S13, the control portion 22 compares the remaining amount of the liquid as a detection result obtained by detection in Step S11 and the remaining amount of the liquid as a calculation result obtained by calculation in Step S12 to each other. A difference of the ejection amount per ejection of the liquid ejecting portion 14 can be calculated based on a difference between the detection result and the calculation result.

In Step S14, the control portion 22 calculates the remaining amount of the liquid contained in the second liquid container 18 based on a standard value. In Step S15, the control portion 22 corrects the remaining amount of the liquid contained by the second liquid container 18, which has been calculated in Step S14 based on a comparison result obtained by comparison in Step S13. At this time, the control portion 22 corrects the ejection amount per ejection of the liquid ejecting portion 14. In Step S16, the control portion 22 changes the ejection amount of the liquid ejected per unit time by the liquid ejecting portion 14, based on the corrected remaining amount of the liquid contained in the second liquid container 18. That is, when the corrected remaining amount of the liquid is small, the ejection amount of the liquid ejected per unit time by the liquid ejecting portion 14 is reduced.

In Step S17, the control portion 22 determines whether or not the remaining amount of the liquid contained in the second liquid container 18 is smaller than a threshold. At this time, the control portion 22 compares the remaining amount of the liquid, which has been corrected in Step S15 to the threshold. When the remaining amount of the liquid contained in the second liquid container 18 is smaller than the threshold, the control portion 22 causes the process to proceed to Step S18. In Step S17, if any kind of liquid has a remaining amount which is smaller than the threshold among all liquids respectively contained in the plurality of second liquid containers 18, the control portion 22 causes the process to proceed to Step S18. When the remaining amount of the liquid contained in the second liquid container 18 is equal to or greater than the threshold, the control portion 22 ends the remaining-amount determination processing.

In Step S18, the control portion 22 determines whether or not remaining amounts of all the liquids respectively contained in the plurality of second liquid containers 18 are smaller than the threshold. When the remaining amounts of all the liquids contained in the second liquid containers 18 are smaller than the threshold, the control portion 22 causes the process to proceed to Step S19. When any kind of liquid has a remaining amount which is equal to or greater than the threshold among all the liquids respectively contained in the plurality of second liquid containers 18, the control portion 22 causes the process to proceed to Step S21.

In Step S19, the control portion 22 waits until the second liquid container 18 having a remaining amount of the liquid, which is smaller than the threshold is replaced. At this time, the control portion 22 reports replacement of the second liquid container 18 to a user. If the second liquid container 18 is replaced, the control portion 22 ends the remaining-amount determination processing.

In Step S21, the control portion 22 causes the user to select whether or not the state of the liquid ejecting apparatus 11 changes to the monochrome mode. At this time, the control portion 22 reports that the monochrome mode is selectable. When the monochrome mode is selected, the control portion 22 switches the state of the liquid ejecting apparatus 11 to the monochrome mode and then ends the remaining-amount determination processing. When the monochrome mode is not selected, the control portion 22 ends the remaining-amount determination processing in a state where the state of the liquid ejecting apparatus 11 is in the normal mode.

Next, the actions and advantageous effects of the first embodiment will be described.

(1) When the remaining amount of the liquid contained in a liquid container is calculated based on a standard value representing the amount of the liquid contained in the liquid container and a standard value representing the ejection amount of the liquid ejected from the liquid ejecting portion 14, an error between the calculated remaining amount of the liquid and the practical remaining amount of the liquid increases as the liquid containing amount by the liquid container increases. According to the embodiment, the detecting portion 21 detects the remaining amount of the liquid contained in the first liquid container 16 having a relatively large liquid containing amount. In the first liquid container 16, it is possible to recognize the remaining amount of the liquid by the detecting portion 21 with high accuracy. According to the embodiment, the control portion 22 calculates the remaining amount of the liquid contained in the second liquid container 18 having a relatively small liquid containing amount, based on a standard value representing the amount of the liquid contained in the second liquid container 18 and a standard value representing the ejection amount of the liquid ejected from the liquid ejecting portion 14. In the second liquid container 18, since the liquid containing amount is relatively small, a difference between the calculated remaining amount of the liquid and the practical remaining amount of the liquid is small. When the control portion 22 calculates the remaining amount of the liquid in the second liquid container 18, the configuration can be simplified in comparison to a case where the detecting portion 21 detects the remaining amount of the liquid contained by the second liquid container 18. Thus, it is possible to reduce the error in the remaining amount of the liquid with a simple configuration.

(2) The second mounting portion 19 is configured to be capable of mounting an integrated type second liquid container 28 in which a plurality of second liquid containers 18 is integrally formed. In this case, it is possible to simplify the configuration of the second mounting portion 19 mounted in the second liquid container 18.

(3) The control portion 22 allows the liquid ejecting portion 14 to perform printing until the remaining amounts of all liquids respectively contained in the plurality of second liquid containers 18 are smaller than a threshold. In the embodiment, the second liquid containers 18 mounted in the second mounting portion 19 is set to be the integrated type second liquid container 28 in which the plurality of second liquid containers 18 is integrally formed. Therefore, when the second liquid container 18 is replaced, all the second liquid containers 18 are replaced together. At this time, in the plurality of second liquid containers 18, if the remaining amounts of the liquids have a difference, for example, in a case where the remaining amount of the liquid contained in one second liquid container 18 is small, and the remaining amount of the liquid contained in another second liquid container 18 is large, the liquid is easily wasted when the second liquid containers 18 are replaced.

According to the embodiment, since printing can be continuously performed by the liquid ejecting portion 14 until the remaining amounts of all the liquids respectively contained in the plurality of second liquid containers 18 are smaller than the threshold, it is possible to reduce waste of the liquid when the second liquid container 18 is replaced.

(4) When a plurality of second mounting portions 19 is provided, it is possible to separately replace the plurality of second liquid containers 18 which is respectively mounted in the plurality of second mounting portions 19.

(5) The second mounting portion 19 is configured to be capable of mounting the second liquid container 18 in which the porous member 45 is provided in the storage chamber 34 that contains the liquid. According to the embodiment, since the porous member 45 absorbs the liquid, it is possible to hold the liquid in the storage chamber 34.

(6) The control portion 22 reduces the ejection amount of the liquid ejected per unit time by the liquid ejecting portion 14, depending on that the remaining amount of the liquid contained in the second liquid container 18 is reduced. In the liquid ejecting apparatus 11, when the ejection amount of the liquid ejected per unit time by the liquid ejecting portion 14 is large, the liquid is strongly sucked from the storage chamber 34 of the second liquid container 18, which includes the porous member 45. At this time, if the remaining amount of the liquid contained by the second liquid container 18 is small, an air may be supplied from the second liquid container 18 into the liquid ejecting portion 14. From this point, according to the embodiment, the ejection amount of the liquid ejected per unit time by the liquid ejecting portion 14 is reduced, depending on that the remaining amount of the liquid contained in the second liquid container 18 is reduced. Thus, it is possible to reduce a concern of a supply of the air into the liquid ejecting portion 14.

(7) The number of nozzles 13 corresponding to one second liquid container 18 is smaller than the number of nozzles 13 corresponding to the first liquid container 16. Thus, it is possible to reduce the ejection amount of the liquid contained in the second liquid container 18 having a relatively small containment amount. Accordingly, it is possible to perform printing for a long term.

(8) When the remaining amount of the liquid contained in the second liquid container 18 is smaller than the threshold, the control portion 22 sets in a state where performing a monochrome mode in which the liquid is ejected not from the nozzles 13 corresponding to the second liquid container 18 but from the nozzles 13 corresponding to the first liquid container 16 is possible. Thus, since the liquid contained in the first liquid container 16 is used instead of the liquid of which the remaining amount is small and which is contained in the second liquid container 18, it is possible to perform printing for a long term.

(9) The control portion 22 compares the calculated remaining amount of the liquid contained in the first liquid container 16 to the remaining amount of the liquid contained in the first liquid container 16, which has been detected by the detecting portion 21, and corrects the calculation result of the remaining amount of the liquid contained in the second liquid container 18 based on the comparison. Thus, it is possible to reduce the error in the remaining amount of the liquid contained in the second liquid container 18.

The first embodiment changed in a manner as follows can be implemented. The first embodiment and the following modification example can be performed in combination thereof in a range without technically conflicting.

The disposition of the first mounting portion 17 and the second mounting portion 19 in the liquid ejecting apparatus 11 may be changed.

Figure 5:
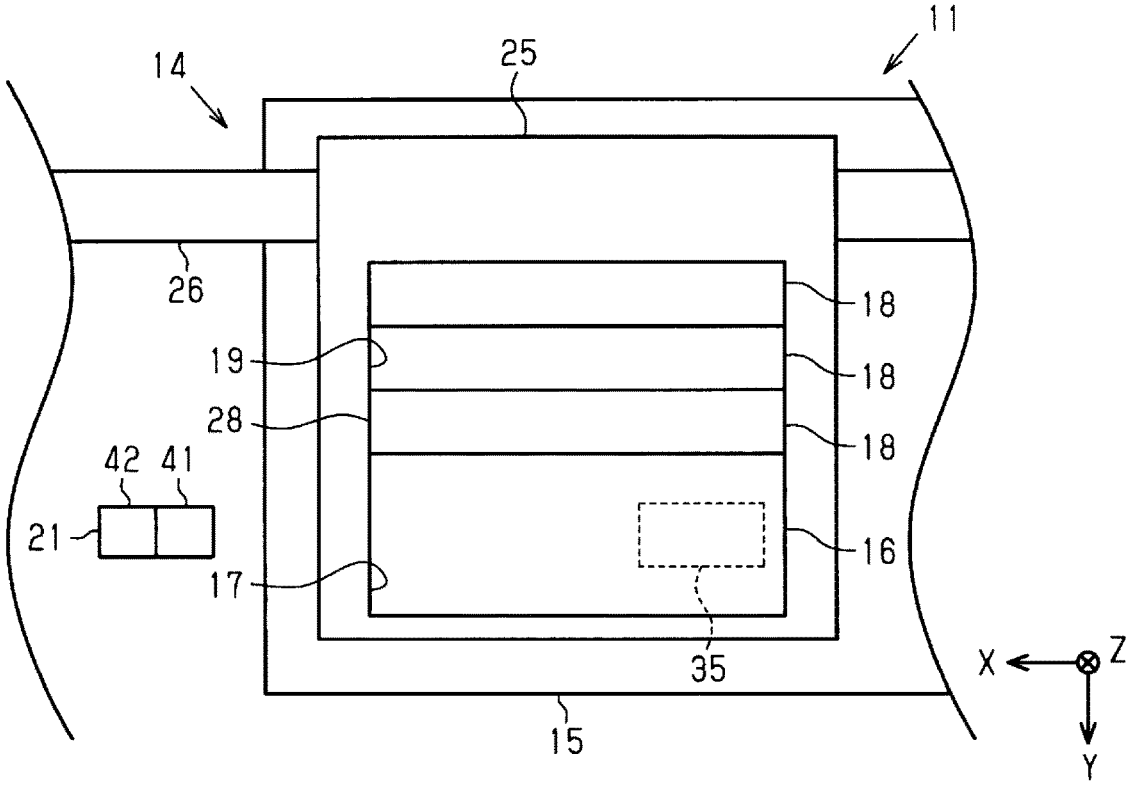
FIG. 5 is a top view illustrating a liquid ejecting apparatus in a modification example.

As illustrated in FIG. 5, the first mounting portion 17 and the second mounting portion 19 may be located to be arranged in the carriage 25 in the sub-scanning direction Y In the modification example, the first liquid container 16 mounted in the first mounting portion 17 and the second liquid container 18 mounted in the second mounting portion 19 are located to be arranged in the sub-scanning direction Y. The first liquid container 16 mounted in the first mounting portion 17 is located at a position allowing the detecting portion 21 to detect the remaining amount of the liquid, in the carriage 25.

Figure 6:
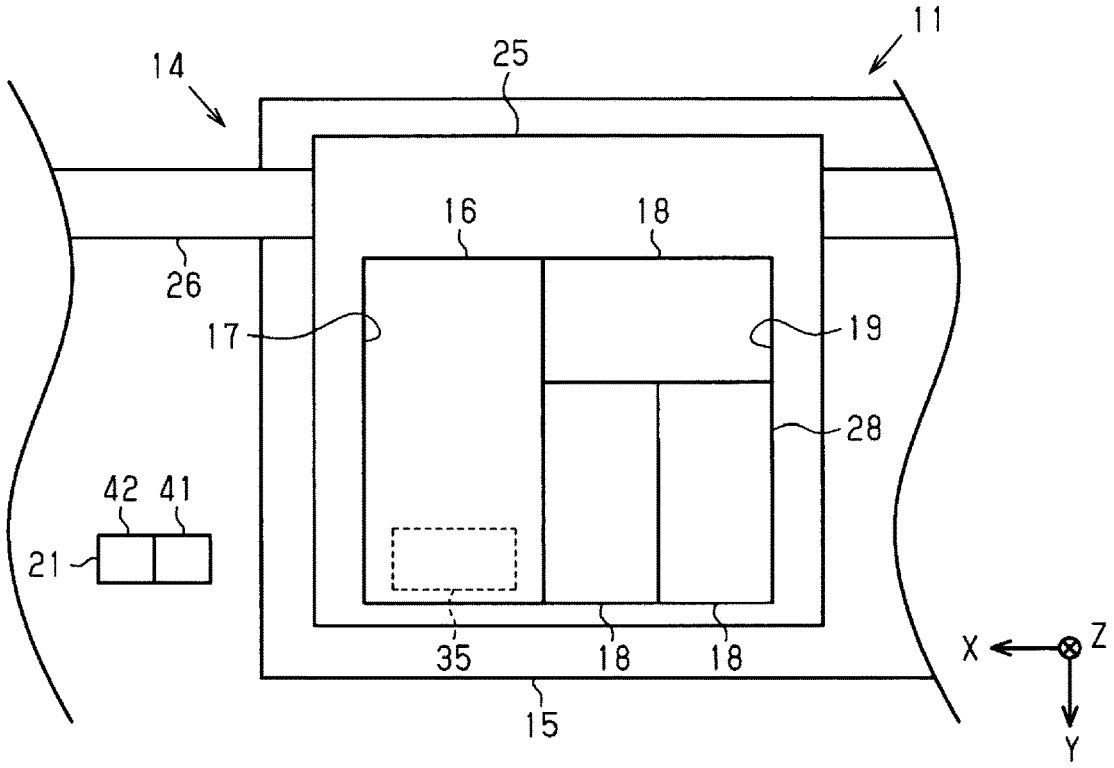
FIG. 6 is a top view illustrating a liquid ejecting apparatus in another modification example.

As illustrated in FIG. 6, the first mounting portion 17 and the second mounting portion 19 may be located to be arranged in the main scanning direction X in the carriage 25. In the modification example, the first mounting portion 17 is located closer to the detecting portion 21 than the second mounting portion 19 in the main scanning direction X. Regarding three second liquid containers 18 mounted in the second mounting portion 19, two liquid containers are located to be arranged in the main scanning direction X, and the two liquid containers arranged in the main scanning direction X and the remaining one liquid container are located to be arranged in the sub-scanning direction Y, in the carriage 25. The first liquid container 16 mounted in the first mounting portion 17 is located at a position allowing the detecting portion 21 to detect the remaining amount of the liquid, in the carriage 25.

The first liquid container 16 including the porous member 45 as the negative-pressure generation mechanism may be mounted in the first mounting portion 17.

The second liquid container 18 including the differential pressure valve 44 as the negative-pressure generation mechanism may be mounted in the second mounting portion 19.

When the control portion 22 calculates the remaining amount of the liquid, the ejection amount of the liquid by cleaning of the head 24, the ejection amount of the liquid by flushing for suppressing an occurrence of clogging of the nozzle 13, and the like may be considered in addition to the ejection amount of the liquid by printing. The cleaning means an operation of forcibly ejecting the liquid from the head 24, for example, by pressurizing the inside of the head 24 or sucking the liquid from the head 24. Thus, it is possible to discharge the thickened or solidified liquid from the head 24. The flushing means an operation of ejecting the liquid regardless of printing, in order to suppress thickening or solidification of the liquid in the nozzle 13.

Second Embodiment

Figure 7:
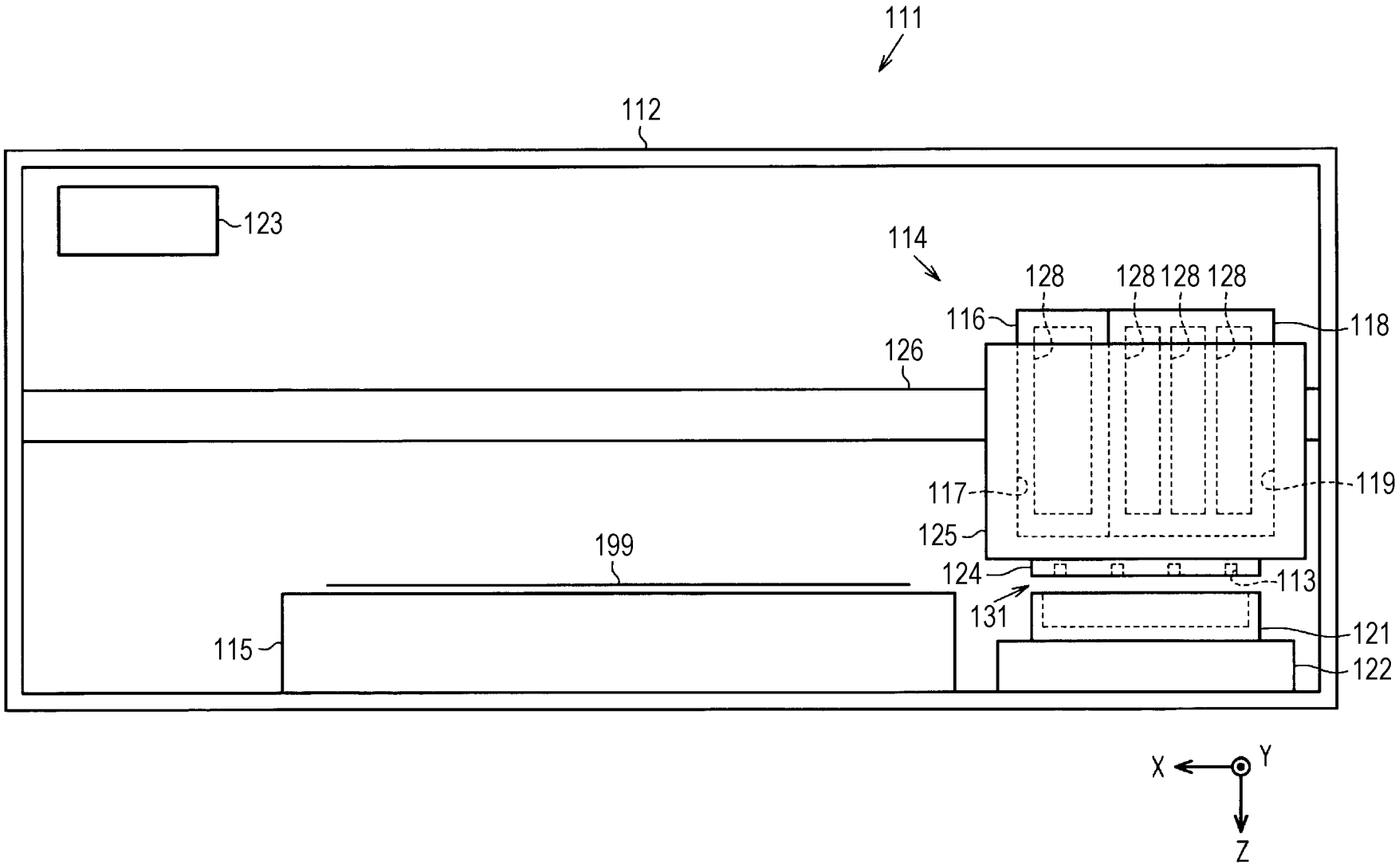
FIG. 7 is a front view schematically illustrating a liquid ejecting apparatus according to a second embodiment.

As illustrated in FIG. 7, a liquid ejecting apparatus 111 includes a housing 112. The liquid ejecting apparatus 111 includes a liquid ejecting portion 114 and a support base 115. The liquid ejecting portion 114 performs printing by ejecting a liquid from a plurality of nozzles 113 to a medium 199. The support base 115 supports the medium 199. The liquid ejecting apparatus 111 includes a first mounting portion 117 and a second mounting portion 119. The first mounting portion 117 is capable of mounting a first liquid container 116 that contains a liquid, therein. The second mounting portion 119 is capable of mounting a second liquid container 118 that contains a liquid.

The liquid ejecting apparatus 111 includes a cap 121 and a discharge mechanism 122. The cap 121 is capable of forming a closed space to which the nozzle 113 opens. The discharge mechanism 122 forcibly discharges the liquid from the nozzle 113. The liquid ejecting apparatus 111 includes a control portion 123 that controls the liquid ejecting portion 114. In the embodiment, the control portion 123 collectively controls the entirety of the apparatus, which includes the liquid ejecting portion 114, the cap 121, the discharge mechanism 122, and the like. The control portion 123 is configured with a CPU, a memory, and the like.

The liquid ejecting portion 114 includes a head 124 including the plurality of nozzles 113, a carriage 125 in which the head 124 is mounted, and a guide shaft 126 that supports the carriage 125. The carriage 125 is allowed to move along the guide shaft 126. The head 124 ejects the liquid to the medium 199 supported by the support base 115, with scanning along with the carriage 125, and thereby prints an image on the medium 199. Therefore, the guide shaft 126 extends in a main scanning direction X which is a direction in which the head 124 performs scanning, in the liquid ejecting apparatus 111. In the embodiment, a position on the right end in the main scanning direction X in FIG. 7 is set as a home position of the carriage 125. When being in a standby state of not performing printing on the medium 199, the carriage 125 waits at the home position. The medium 199 supported by the support base 115 is transported on the support base 115 in a sub-scanning direction Y which is a direction different from the main scanning direction X and a vertical direction Z.

The liquid ejecting portion 114 receives liquids supplied from the first liquid container 116 mounted in the first mounting portion 117 and the second liquid container 118 mounted in the second mounting portion 119. The first liquid container 116 and the second liquid container 118 contain liquids of types different from each other. The first liquid container 116 and the second liquid container 118 are ink cartridges, for example.

In the embodiment, the first mounting portion 117 and the second mounting portion 119 are provided in the liquid ejecting portion 114. Specifically, the first mounting portion 117 and the second mounting portion 119 are provided in the carriage 125. Therefore, the first liquid container 116 and the second liquid container 118 that contain liquids are mounted in the carriage 125 by being mounted in the first mounting portion 117 and the second mounting portion 119. The first mounting portion 117 and the second mounting portion 119 are located to be arranged in the carriage 125 in the main scanning direction X. The second mounting portion 119 is located closer to the home position than the first mounting portion 117 in the main scanning direction X.

In the embodiment, the liquid ejecting apparatus 111 is a so-called on-carriage type in which the first liquid container 116 and the second liquid container 118 are mounted in the carriage 125. The liquid ejecting apparatus 111 may be an off-carriage type in which the first liquid container 116 and the second liquid container 118 are not mounted in the carriage 125. That is, the first mounting portion 117 and the second mounting portion 119 may not be provided in the carriage 125. In this case, the first liquid container 116 mounted in the first mounting portion 117 and the second liquid container 118 mounted in the second mounting portion 119 are coupled to the head 124 through a tube, for example.

The second mounting portion 119 is set to be capable of mounting the second liquid container 118 that contains plural kinds of liquids different from that of the liquid contained in the first liquid container 116. That is, the second liquid container 118 is set to be capable of containing plural kinds of liquids. The first liquid container 116 and the second liquid container 118 include a storage chamber 128 that contains a liquid. The second liquid container 118 includes a plurality of storage chambers 128. In the embodiment, the first liquid container 116 includes one storage chamber 128. In the embodiment, the second liquid container 118 includes three storage chambers 128. The first liquid container 116 contains a black ink. The second liquid containers 118 contain color inks. The second liquid containers 118 contain a cyan ink, a magenta ink, and a yellow ink in the storage chambers 128, respectively.

The head 124 includes a plurality of nozzle rows 131. Each nozzle row is configured with a plurality of nozzles 113. In the embodiment, the nozzle row 131 is configured in a manner that the plurality of nozzles 113 is arranged in one line in the sub-scanning direction Y. The plurality of nozzle rows 131 are located in the head 124, so as to be arranged in the main scanning direction X. The plurality of nozzle rows 131 corresponds to the first liquid container 116 and the second liquid container 118 mounted in the first mounting portion 117 and the second mounting portion 119, respectively. That is, the liquid contained in the first liquid container 116 or the second liquid container 118 is ejected from the predetermined specific nozzle row 131.

In the embodiment, the head 124 includes four nozzle rows 131. The number of nozzles 113 constituting one nozzle row 131 is equal to the number of nozzles 113 constituting another nozzle row 131. One nozzle row 131 located close to the first mounting portion 117 among the four nozzle rows 131 arranged in the main scanning direction X corresponds to the first liquid container 116. Other three nozzle rows 131 correspond to the second liquid containers 118. That is, a black ink is ejected from the one nozzle row 131 located close to the first mounting portion 117 among the four nozzle rows 131 arranged in the main scanning direction X. A cyan ink, a magenta ink, and a yellow ink are ejected from the other three nozzle rows 131 among the four nozzle rows 131 arranged in the main scanning direction X. As described above, the nozzles 113 constituting the nozzle row 131 correspond to the liquids contained in the storage chamber 128 of the first liquid container 116 and the storage chamber 128 of the second liquid container 118.

The cap 121 is located to be adjacent to the support base 115 in the main scanning direction X. The cap 121 is configured to be capable of coming into contact with the head 124 mounted in the carriage 125 located at the home position. For example, the cap 121 moves up and down so as to come into contact with the head 124 or to be separated from the head 124. The head 124 may be configured to move up and down with respect to the cap 121.

The cap 121 comes into contact with the head 124 so as to cause the edge portion thereof to surround the nozzle 113, and thereby forms a closed space to which the nozzle 113 opens. As described above, the cap 121 coming into contact with the head 124 so as to form the closed space to which the nozzle 113 opens is referred to as capping. That is, the cap 121 performs capping of the head 124, and thereby forms the closed space to which the nozzle 113 opens. In the embodiment, the cap 121 performs capping so as to surround all nozzles 113 formed in the head 124.

If the cap 121 performs capping of the head 124, evaporation of the liquid in the nozzle 113 is suppressed. Therefore, thickening and solidification of the liquid in the nozzle 113 are suppressed. Thus, ejection accuracy of the nozzle 113 for ejecting the liquid is maintained.

The head 124 may eject the liquid toward the cap 121 before being capped. In this case, the head 124 ejects the liquid having no relation with printing, into the cap 121. If capping is performed in a state where the liquid remains in the cap 121, the closed space formed by the cap 121 is moisturized by the liquid in the cap 121. Thus, thickening and solidification of the liquid in the nozzle 113 are more suppressed. In this manner, ejection of the liquid having no relation with printing is referred to as idle ejection or flushing.

The idle ejection may be performed in the middle of printing in addition to time before capping. In this case, an occurrence of a situation in which the liquid in the nozzle 113 is thickened or solidified in the middle of printing is suppressed. When the head 124 performs idle ejection in the middle of printing, the head 124 may eject the liquid into the cap 121 or eject the liquid into a member different from the cap 121.

The discharge mechanism 122 is coupled to the cap 121. The discharge mechanism 122 is configured to be capable of sucking a substance in the cap 121. If the discharge mechanism 122 sucks the substances in the cap 121 in a state where the head 124 is capped with the cap 121, the closed space formed by capping has negative pressure. If the negative pressure reaches the nozzle 113 in the head 124, the liquid is discharged from the nozzle 113 into the cap 121. In this manner, forcibly discharging the liquid from the nozzle 113 by sucking is referred to as suction cleaning. The thickened and solidified liquid is discharged from the nozzle 113 by performing suction cleaning. That is, ejection accuracy of the nozzle 113 for ejecting the liquid is maintained. The discharge mechanism 122 sucks the substances in the cap 121 in a state where the head 124 is not capped with the cap 121, and thereby discharges the liquid in the cap 121.

Preferably, when the head 124 is capped with the cap 121, the cap 121 airtightly seals the inside thereof so as to block the entrance and the exit of fluid such as an air and a liquid inside and outside of the cap 121. When the head 124 is capped with the cap 121, the cap 121 may not seal airtightly the inside of the cap 121. The cap 121 may form the closed space in which negative pressure as large as the discharge mechanism 122 can suck the substance in the cap 121 so as to suck the liquid from the nozzle 113, in a state where the head 124 is capped with the cap 121.

The control portion 123 detects the remaining amounts of the liquids contained in the first liquid container 116 and the second liquid container 118. In the embodiment, the control portion 123 detects the remaining amounts of the liquids which are currently contained in the first liquid container 116 and the second liquid container 118, based on the initial remaining amounts of the liquids contained in the first liquid container 116 and the second liquid container 118 and the consumption amount of the liquid consumed by the liquid ejecting portion 114. The initial remaining amounts mean the remaining amounts of the liquids contained in the first liquid container 116 and the second liquid container 118 when being mounted in the first mounting portion 117 and the second mounting portion 119. The first liquid container 116 and the second liquid container 118 includes a storage element that stores the initial remaining amount. The control portion 123 acquires the initial remaining amount from the storage element. The consumption amount refers to the amount of the liquid consumed by printing, suction cleaning, idle ejection, and the like.

The liquid ejecting apparatus 111 may include a sensor capable of detecting the remaining amount of the liquid contained in each of the first liquid container 116 mounted in the first mounting portion 117 and the second liquid container 118 mounted in the second mounting portion 119. In this case, the control portion 123 detects the remaining amounts of the liquids contained in the first liquid container 116 and the second liquid container 118 with the sensor. As the sensor capable of detecting the remaining amount of the liquid, for example, an optical sensor, a capacitive sensor, and an ultrasonic sensor can be employed.

The control portion 123 compares the detected remaining amount of the liquid to a threshold. The control portion 123 stores a first threshold and a second threshold as the threshold. The first threshold has a value greater than the second threshold. The first threshold indicates the lower limit amount of the liquid expected to be necessary for printing. The second threshold indicates the lower limit amount of the liquid expected to be necessary for ejecting the liquid from the head 124.

When the remaining amount of the liquid is smaller than the first threshold, if printing continues in this state, the remaining amount of the liquid may become insufficient in the middle of printing. If the remaining amount of the liquid becomes insufficient in the middle of printing, it may not be possible to normally eject the liquid from the nozzle 113. In addition, if this liquid is caused to be ejected from the nozzle 113, an air may flow into the head 124 from the nozzle 113. Therefore, when the remaining amount of the liquid is smaller than the first threshold, it is not preferable that printing is performed with this liquid.

When the remaining amount of the liquid is smaller than the second threshold, if this liquid is caused to be ejected from the nozzle 113, an air may flow into the head 124 from the nozzle 113. When the air flows into the head 124, if suction cleaning and the like are not performed, it is not possible to discharge the air from the nozzle 113. Thus, it is not possible to normally eject the liquid. Therefore, when the remaining amount is smaller than the second threshold, it is not preferable that this liquid is ejected.

If the remaining amount of the liquid contained in the first liquid container 116 is detected, the control portion 123 compares the detected remaining amount to the first threshold. When the remaining amount of the liquid contained in the first liquid container 116 is smaller than the first threshold, the control portion 123 reports that the remaining amount of the liquid is small. At this time, the control portion 123 performs a report, for example, via a liquid crystal screen of the liquid ejecting apparatus 111, and a computer which is electrically coupled to the liquid ejecting apparatus 111. The control portion 123 urges a user to replace the first liquid container 116 by the reporting.

If the remaining amount of the liquid contained in the second liquid container 118 is detected, the control portion 123 compares the detected remaining amount to the first threshold and the second threshold. The control portion 123 switches the mode of the liquid ejecting apparatus 111 based on the remaining amount of the liquid contained in the second liquid container 118, the first threshold, and the second threshold. The control portion 123 has a plurality of modes. The liquid ejecting apparatus 111 operates based on the mode.

The control portion 123 has a normal mode as a normal state. The control portion 123 has at least two modes of a replacement mode, a monochrome mode, and a continuation mode in addition to the normal mode. In particular, the control portion 123 preferably has the replacement mode. That is, the control portion 123 preferably has at least one mode of the replacement mode, the monochrome mode, and the continuation mode. Therefore, the control portion 123 may have the replacement mode and the monochrome mode or may have the replacement mode and the continuation mode, among the three modes. In the embodiment, the control portion 123 has all the three modes which are the replacement mode, the monochrome mode, and the continuation mode.

The normal mode is a mode when the remaining amounts of the liquids contained in the first liquid container 116 and the second liquid container 118 are sufficient. In the normal mode, all the liquids contained in the first liquid container 116 and the second liquid container 118 can be used. Therefore, in the normal mode, an image can be printed on a medium 199 in full color.

The replacement mode is a mode in which the second liquid container 118 is replaced. In the replacement mode, the carriage 125 stops at a predetermined position in the housing 112. The carriage 125 waits at this position until the second liquid container 118 is replaced. If the replacement of the second liquid container 118 completes, the mode transitions to the normal mode.

The monochrome mode is a mode in which printing is performed with the liquid contained in the first liquid container 116. That is, in the monochrome mode, the liquid contained in the second liquid container 118 is not used for printing. In the embodiment, in the monochrome mode, an image is printed with only a black ink. Therefore, in the monochrome mode, an image printed on a medium 199 is monochromic.

The continuation mode is a mode in which printing continues without using the liquid having a remaining amount smaller than the first threshold among the plural kinds of liquids contained in the second liquid containers 118. That is, in the continuation mode, printing is performed with the liquid contained in the first liquid container 116 and the liquid having a sufficient remaining amount among the liquids contained in the second liquid containers 118. In the embodiment, printing is performed without using an ink having a small remaining amount among color inks. Therefore, in the continuation mode, an image printed on a medium 199 is in a state where some colors are missed.

When the remaining amount of at least one kind of liquid among the plural kinds of liquids contained in the second liquid containers 118 is smaller than the first threshold, the control portion 123 sets in a state in which selection of one of the replacement mode, the monochrome mode, and the continuation mode is possible. That is, when the remaining amount of at least one kind of liquid among the plural kinds of liquids contained in the second liquid containers 118 is smaller than the first threshold, the control portion 123 causes a user to select one of the replacement mode, the monochrome mode, and the continuation mode.

When the remaining amount of the liquid contained in the second liquid container 118 is smaller than the first threshold, the control portion 123 reports that the remaining amount of this liquid is small. At this time, the control portion 123 performs a report, for example, via a liquid crystal screen of the liquid ejecting apparatus 111, and a computer which is electrically coupled to the liquid ejecting apparatus 111. At this time, the control portion 123 causes the user to select any one of the replacement mode, the monochrome mode, and the continuation mode via the liquid crystal screen of the liquid ejecting apparatus 111, a computer which is electrically coupled to the liquid ejecting apparatus 111, and the like.

When the remaining amount of a specific liquid contained in the second liquid container 118 is smaller than the first threshold, if printing continues in this state, the remaining amount of the liquid may become insufficient in the middle of printing. Therefore, it is not preferable that printing continues with a liquid having a remaining amount which is smaller than the first threshold. When the remaining amount of the specific liquid contained in the second liquid container 118 is smaller than the first threshold, but the remaining amounts of other liquids contained in the second liquid container 118 are sufficient, if the second liquid containers 118 are replaced, the liquids are wasted. For example, when the remaining amount of a cyan ink is smaller than the first threshold, but the remaining amounts of a magenta ink and a yellow ink are equal to or greater than the first threshold, if the second liquid containers 118 are replaced, the magenta ink and the yellow ink having a sufficient remaining amount are discarded. In this manner, the liquids are wasted.

In the embodiment, the liquid ejecting apparatus 111 can select the monochrome mode or the continuation mode in addition to the replacement mode, when the remaining amount of the specific liquid contained in the second liquid container 118 is smaller than the first threshold. When the monochrome mode is selected, printing can continue by using the liquid contained in the first liquid container 116. When the continuation mode is selected, printing can continue by using the liquids other than the liquid having a remaining amount which is smaller than the first threshold. Thus, even when the remaining amount of at least one kind of liquid among the plural kinds of liquids contained in the second liquid containers 118 is smaller than the first threshold, it is possible to continue printing by using the liquid having a sufficient remaining amount. Accordingly, it is possible to continue printing. In particular, when the continuation mode is selected, the liquid having a sufficient remaining amount is used among the liquids contained in the second liquid containers 118. Thus, it is possible to reduce waste of the liquid when the second liquid containers 118 are replaced.

When the monochrome mode or the continuation mode is selected, it is preferable that the control portion 123 prohibits the nozzle 113 corresponding to the liquid having a remaining amount which is smaller than the first threshold to eject the liquid relating to printing and is allowed to perform idle ejection which is ejection of a liquid having no relation with printing. That is, in the monochrome mode or the continuation mode, it is preferable that the control portion 123 does not use the liquid having a remaining amount smaller than the first threshold, for printing, but uses the liquid in idle ejection.

In the monochrome mode or the continuation mode, the nozzle 113 which is not used for printing is provided. In the nozzle 113 which is not used for printing, the liquid easily stays, and thus thickening and solidification of the liquid are accelerated. Therefore, in the monochrome mode or the continuation mode, it is preferable that idle ejection is performed on the nozzle 113 which is not used for printing. Normally, the amount of the liquid expected to be necessary for performing idle ejection is smaller than the amount of the liquid expected to be necessary for performing printing. Thus, even when the remaining amount of the liquid is smaller than the first threshold, the idle ejection can be performed with this liquid. Since the idle ejection is performed, thickening and solidification of the liquid in the nozzle 113 which is not used for printing are suppressed.

Preferably, the control portion 123 reduces the ejection amount of the liquid ejected in one idle ejection depending on that the remaining amount of the liquid having a remaining amount smaller than the first threshold is small. In the monochrome mode or the continuation mode, if the idle ejection repeats by using the liquid having a remaining amount smaller than the first threshold, the remaining amount of this liquid is more reduced. Therefore, the control portion reduces the ejection amount in the idle ejection, depending on that the remaining amount of the liquid, which is smaller than the first threshold is small. Thus, since the amount of the consumed liquid by the idle ejection is reduced, it is possible to perform idle ejection for a long term.

When idle ejection is performed in the cap 121 before the closed space is formed after the monochrome mode or the continuation mode is selected, it is preferable that the control portion 123 sets the ejection amount of the liquid when this liquid having a remaining amount smaller than the first threshold among the plural kinds of liquids contained in the second liquid containers 118 is ejected from the nozzle 113 to be smaller than the ejection amounts of other liquids when the other liquids except for the liquid having a remaining amount smaller than the first threshold among the plural kinds of liquids contained in the second liquid containers 118 are ejected from the nozzles 113. If setting is performed in this manner, it is possible to reduce the amount of the consumed liquid when idle ejection is performed in the cap 121 before capping in which the nozzle 113 is to be moisturized.

When the remaining amount of at least one kind of liquid among the plural kinds of liquids contained in the second liquid containers 118 is smaller than the second threshold smaller than the first threshold, the control portion 123 preferably prohibits ejection of the liquid from the nozzle 113 corresponding to the liquid having a remaining amount which is smaller than the second threshold among the plural kinds of liquids contained in the second liquid containers 118. As described above, if the liquid in a state where the remaining amount is smaller than the second threshold is set to be ejected, an air may flow into the head 124 from the nozzle 113. Therefore, if the control portion prohibits ejection from the nozzle 113 corresponding to the liquid having a remaining amount smaller than the second threshold, it is possible to reduce a concern of an air flowing into the head 124. In the embodiment, the second threshold refers to the lower limit amount of the liquid expected to be necessary for performing idle ejection.

When a difference between the remaining amount of one liquid among the plural kinds of liquids contained in the second liquid containers 118 and the remaining amounts of other liquids is equal to or greater than a predetermined value, the control portion 123 preferably sets in a state where selection of a save mode in which printing is performed by reducing the ejection amount from the nozzle 113 corresponding to the liquid having a small remaining amount is possible. That is, the control portion 123 may have the save mode in addition to the replacement mode, the monochrome mode, and the continuation mode. If a difference of the remaining amount between the plural kinds of liquids contained in the second liquid containers 118 occurs, the liquids are easily wasted when the second liquid container 118 is replaced. Therefore, if the control portion reduces the ejection amount from the nozzle 113 corresponding to the liquid having a small remaining amount, it is possible to reduce a difference of the remaining amount of the liquid in the second liquid container 118.

When the replacement mode is selected without selecting the monochrome mode or the continuation mode even once, it is preferable that the control portion 123 does not perform discharge of the liquid by the discharge mechanism 122 after the second liquid container 118 is replaced. When there is a record in which the monochrome mode or the continuation mode is selected before the replacement mode is selected, the control portion 123 preferably performs discharge of the liquid by the discharge mechanism 122 after the second liquid container 118 is replaced. If the monochrome mode or the continuation mode is selected when the remaining amount of the liquid contained in the second liquid container 118 is smaller than the first threshold, the nozzle 113 which is not used for printing is provided. Since the amount of the liquid ejected in idle ejection is smaller than that in a printing operation, thickening and solidification of the liquid in the nozzle 113 which is not used for printing may be accelerated even though the idle ejection is performed. Therefore, in a case where the monochrome mode or the continuation mode has been selected, when the second liquid container 118 has been replaced, the liquid may be discharged by the discharge mechanism 122. If the liquid is discharged, it is possible to discharge the liquid of which thickening and solidification have been accelerated in the monochrome mode or the continuation mode, from the nozzle 113.

In a case where the replacement mode is selected when the remaining amount of the liquid contained in the second liquid container 118 is smaller than the first threshold, stay of the liquid in the nozzle 113 is more difficult than that when the monochrome mode or the continuation mode is selected. That is, when the replacement mode is selected, acceleration of thickening and solidification of the liquid in the nozzle 113 has difficulty. Therefore, when the replacement mode is selected, the liquid may not be discharged by the discharge mechanism 122. With such an operation, the liquid is not forcibly discharged by the discharge mechanism 122 when the second liquid container 118 is replaced, and thus it is possible to reduce consumption of the liquid.

Preferably, the control portion 123 increases strength of discharging the liquid by the discharge mechanism 122, which is performed after the second liquid container 118 is replaced, as time elapsed after the monochrome mode or the continuation mode is selected becomes longer. As the time elapsed after the monochrome mode or the continuation mode is selected becomes longer, thickening and solidification of the liquid in the nozzle 113 which is not used for printing are accelerated. Therefore, it is possible to effectively discharge the liquid in the nozzle 113 by increasing the strength of discharge of the discharge mechanism 122 in accordance with the elapsed time.

When the remaining amounts of the plural kinds of liquids contained in the second liquid containers 118 are smaller than the first threshold, the control portion 123 preferably can select the replacement mode or the monochrome mode. When the remaining amounts of all the liquids contained in the second liquid containers 118 are smaller than the first threshold, it is not preferable that the liquids contained in the second liquid containers 118 are used for printing. Even in such a case, if the monochrome mode is selected, it is possible to continue printing with the liquid contained in the first liquid container 116.

Next, an operation of the liquid ejecting apparatus 111 will be described.

The control portion 123 detects the remaining amount of the second liquid container 118 and then performs remaining-amount comparison processing of comparing the detected remaining amount to a threshold. The liquid ejecting apparatus 111 performs the remaining-amount comparison processing, for example, at timings such as a timing in printing an image, a timing after printing ends, and a timing just after power is supplied. When the liquid ejecting apparatus performs the remaining-amount comparison processing, the control portion may compare the remaining amount of the liquid contained in the first liquid container 116 to the threshold.

Figure 8:
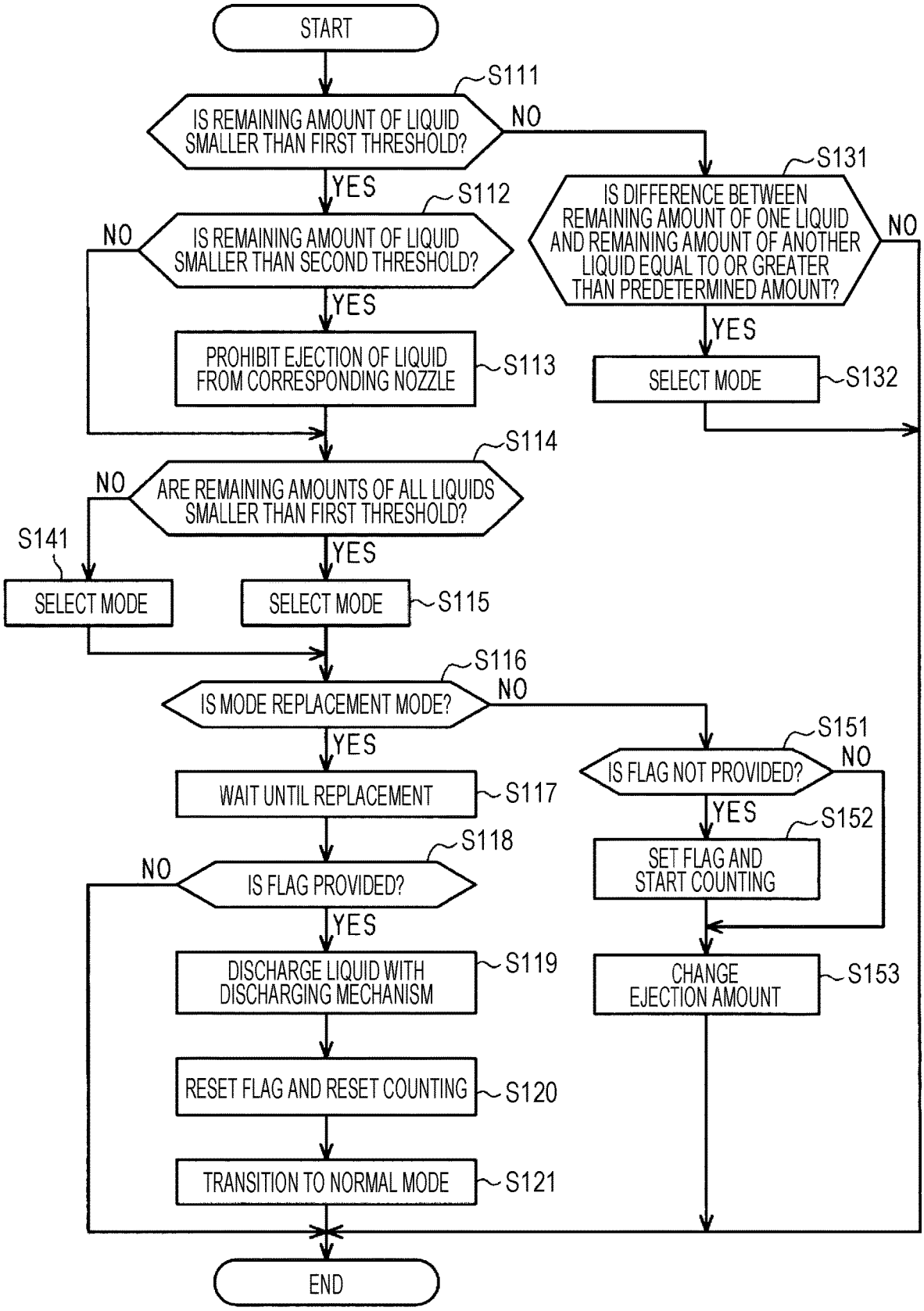
FIG. 8 is a flowchart illustrating a processing routine of remaining-amount comparison processing.

As illustrated in FIG. 8, in Step S111, the control portion 123 that performs the remaining-amount comparison processing determines whether or not the remaining amount of the liquid contained in the second liquid container 118 is smaller than a first threshold. When any kind of liquid has a remaining amount smaller than the first threshold among plural kinds of liquids contained in the second liquid containers 118, the control portion 123 causes the process to proceed to Step S112. When the remaining amounts of all the liquids contained in the second liquid containers 118 are equal to or greater than the first threshold, the control portion 123 causes the process to proceed to Step S131.

In Step S112, the control portion 123 determines whether or not the remaining amount of the liquid contained in the second liquid container 118 is smaller than a second threshold. When any kind of liquid has a remaining amount smaller than the second threshold among the plural kinds of liquids contained in the second liquid containers 118, the control portion 123 causes the process to proceed to Step S113. When the remaining amounts of all the liquids contained in the second liquid containers 118 are equal to or greater than the second threshold, the control portion 123 causes the process to proceed to Step S114.

In Step S113, the control portion 123 prohibits ejection of the liquid from the nozzle 113 corresponding to the liquid having a remaining amount which is smaller than the second threshold among the plural kinds of liquids contained in the second liquid containers 118. The control portion 123 totally prohibits ejection from the nozzle 113 corresponding to the liquid having a remaining amount smaller than the second threshold by a printing operation, ejection by idle ejection, and ejection by suction cleaning.

In Step S114, the control portion 123 determines whether or not the remaining amounts of all the plural kinds of liquids contained in the second liquid containers 118 are smaller than the first threshold. When the remaining amounts of all the liquids contained in the second liquid container 118 are smaller than the first threshold, the control portion 123 causes the process to proceed to Step S115. When any kind of liquid has a remaining amount smaller than the first threshold among the plural kinds of liquids contained in the second liquid containers 118, the control portion 123 causes the process to proceed to Step S141.

In Step S115, the control portion 123 causes a user to select a mode. At this time, the control portion 123 waits until the user selects the mode. In the embodiment, the mode selectable in Step S115 is a replacement mode or a monochrome mode. In Step S115, since the remaining amounts of all the liquids contained in the second liquid containers 118 are smaller than the first threshold, it is not possible to select the continuation mode. If the mode is selected, the control portion 123 causes the process to proceed to Step S116.

When any kind of liquid has a remaining amount smaller than the first threshold among the plural kinds of liquids contained in the second liquid containers 118 in Step S114, the control portion 123 causes the user to select the mode in Step S141. At this time, the control portion 123 waits until the user selects the mode. In the embodiment, the mode selectable in Step S141 is the replacement mode, the monochrome mode, or a continuation mode. If the mode is selected, the control portion 123 causes the process to proceed to Step S116.

In Step S116, the control portion 123 determines whether or not the mode selected in Step S115 or Step S141 is the replacement mode. When the selected mode is the replacement mode, the control portion 123 causes the process to proceed to Step S117. When the selected mode is not the replacement mode, that is, the selected mode is the monochrome mode or the continuation mode, the control portion 123 causes the process to proceed to Step S151.

In Step S117, the control portion 123 waits until the second liquid container 118 is replaced. If the second liquid container 118 is replaced, the control portion 123 causes the process to proceed to Step S118.

In Step S118, the control portion 123 determines whether or not a flag is provided. The flag is stored in the control portion 123. The flag is information indicating that the monochrome mode or the continuation mode is selected after the second liquid container 118 is mounted in the second mounting portion 119. That is, if the flag is provided, it is understood that the monochrome mode or the continuation mode has been selected in a period from when the second liquid container 118 has been mounted in the second mounting portion 119 to the current time. When the flag is provided, the control portion 123 causes the process to proceed to Step S119. When there is no flag, the control portion 123 ends the remaining-amount comparison processing.

In Step S119, the control portion 123 controls the discharge mechanism 122 to discharges the liquid from the nozzle 113. When the flag is provided, the monochrome mode or the continuation mode is selected until the second liquid container 118 is replaced. Thus, thickening and solidification of the liquid in the nozzle 113 which is not used for printing may be accelerated. Therefore, the control portion controls the liquid to be discharged by the discharge mechanism 122.

In Step S119, the control portion 123 controls the discharge mechanism 122 to discharge the liquid from the nozzle 113 at strength depending on the length of time elapsed after the monochrome mode or the continuation mode has been selected. Therefore, when the monochrome mode or the continuation mode is selected, the control portion 123 starts clocking of time.

In Step S120, the control portion 123 resets the flag. Thus, the control portion 123 makes a state where there is no flag. In Step S120, the control portion 123 resets counting. At this time, the control portion 123 resets and stops the counting.

In Step S121, the control portion 123 transitions to a normal mode from the replacement mode. When transitioning to the normal mode, the control portion 123 cancels the prohibition of the nozzle 113 in which discharge of the liquid has been prohibited. If the mode transitions to the normal mode, the control portion 123 ends the remaining-amount comparison processing.

When there is no flag in Step S118, the control portion 123 skips the processes of Step S119, Step S120, and Step S121. That is, when there is no flag in Step S118, that is, when the monochrome mode or the continuation mode is not selected in the period from when the second liquid container 118 has been replaced until the replacement mode is selected, the control portion 123 does not perform discharge of the liquid by the discharge mechanism 122.

When the remaining amounts of all the liquids contained in the second liquid containers 118 are equal to or greater than the first threshold in Step S111, the control portion 123 determines whether or not a difference between the remaining amount of one liquid among the plural kinds of liquids contained in the second liquid containers 118 and the remaining amounts of other liquids is equal to or greater than a predetermined value, in Step S131. When the difference between the remaining amount of the one liquid and the remaining amounts of the other liquids is equal to or greater than the predetermined value, the control portion 123 causes the process to proceed to Step S132. When the difference between the remaining amount of the one liquid and the remaining amounts of the other liquids is not equal to or greater than the predetermined value, the control portion 123 ends the remaining-amount comparison processing.

In Step S132, the control portion 123 causes a user to select the mode. At this time, the control portion 123 waits until the user selects the mode. In the embodiment, the mode selectable in Step S132 is a save mode or a normal mode. When the save mode is selected, the control portion 123 reduces the ejection amount from the nozzle 113 corresponding to the liquid having a small remaining amount. If the mode is selected, the control portion 123 ends the remaining-amount comparison processing.

When the selected mode is not the replacement mode in Step S116, that is, the selected mode is the monochrome mode or the continuation mode, the control portion 123 determines whether or not the flag is provided, in Step S151. When the flag is provided, the control portion 123 causes the process to proceed to Step S153. When there is no flag, the control portion 123 causes the process to proceed to Step S152.

In Step S152, the control portion 123 sets the flag. In Step S152, the control portion 123 start counting. Since the flag is set, the liquid is discharged by the discharge mechanism 122 when the second liquid container 118 is replaced.

In Step S153, the control portion 123 changes the ejection amount of each nozzle 113 in accordance with the remaining amount of the liquid contained in the second liquid container 118. Specifically, in Step S153, the control portion 123 reduces the ejection amount of the liquid ejected in one idle ejection, depending on that the remaining amount of the liquid having a remaining amount smaller than the first threshold is small. In Step S153, the control portion 123 sets the ejection amount when the liquid having a remaining amount which is smaller than the first threshold among the plural kinds of liquids contained in the second liquid containers 118 is ejected from the nozzle 113, to be smaller than the ejection amount when the liquids other than the liquid having a remaining amount smaller than the first threshold are ejected from the nozzles 113.

Next, the actions and advantageous effects of the second embodiment will be described.

(1) The control portion 123 has at least two modes of the three modes which are the replacement mode, the monochrome mode, and the continuation mode. Therefore, when the remaining amount of the liquid of at least one kind among the plural kinds of liquids contained in the second liquid containers 118 is smaller than the first threshold, the monochrome mode or the continuation mode can be selected in addition to the replacement mode. When the monochrome mode is selected, printing can continue by using the liquid contained in the first liquid container 116. When the continuation mode is selected, printing can continue by using the liquids other than the liquid having a remaining amount which is smaller than the first threshold. Therefore, even when the remaining amount of at least one kind of liquid among the plural kinds of liquids contained in the second liquid containers 118 is smaller than the first threshold, it is possible to continue printing by using the liquid having a sufficient remaining amount.

(2) When the monochrome mode or the continuation mode is selected, the control portion 123 performs only idle ejection which is ejection of a liquid having no relation with printing, on the nozzle 113 corresponding to the liquid having a remaining amount which is smaller than the first threshold. If the control portion performs only idle ejection, idle ejection is performed on the nozzle 113 corresponding to the liquid having a remaining amount which is smaller than the first threshold among the plural kinds of liquids contained in the second liquid containers 118. Thus, it is possible to suppress thickening and solidification of the liquid in the nozzle 113 which is not used for printing. Thus, it is possible to maintain ejection accuracy of the nozzle 113.

(3) The control portion 123 reduces the ejection amount of the liquid ejected in one idle ejection, depending on that the remaining amount of the liquid having a remaining amount smaller than the first threshold is small. If the control portion reduces the ejection amount, when idle ejection is performed, it is possible to reduce consumption of the liquid having a remaining amount which is smaller than the first threshold among the plural kinds of liquids contained in the second liquid containers 118. Thus, it is possible to perform printing for a long term.

(4) When idle ejection is performed in the cap 121 before the closed space is formed after the monochrome mode or the continuation mode is selected, the control portion 123 sets the ejection amount of the liquid when this liquid having a remaining amount smaller than the first threshold among the plural kinds of liquids contained in the second liquid containers 118 is ejected from the nozzle 113 to be smaller than the ejection amounts of other liquids when the other liquids except for the liquid having a remaining amount smaller than the first threshold among the plural kinds of liquids contained in the second liquid containers 118 are ejected from the nozzles 113. If the cap 121 subjected to idle ejection forms a closed space, the nozzle 113 is moisturized by the liquid in the cap 121. Since the ejection amount of the liquid having a remaining amount which is smaller than the first threshold among the plural kinds of liquids contained in the second liquid containers 118 is reduced when idle ejection is performed in the cap 121, it is possible to reduce consumption of the liquid. Thus, it is possible to perform printing for a long term.

(5) When the remaining amount of at least one kind of liquid among the plural kinds of liquids contained in the second liquid containers 118 is smaller than the second threshold smaller than the first threshold, the control portion 123 totally prohibits ejection of the liquid from the nozzle 113 corresponding to the liquid having a remaining amount which is smaller than the second threshold among the plural kinds of liquids contained in the second liquid containers 118. Thus, it is possible to reduce a concern of an air flowing into the head 124 from the nozzle 113 corresponding to the liquid having a remaining amount which is smaller than the second threshold among the liquids contained in the second liquid containers 118.

(6) When a difference between the remaining amount of one liquid among the plural kinds of liquids contained in the second liquid containers 118 and the remaining amounts of other liquids is equal to or greater than a predetermined value, the control portion 123 sets in a state where selection of a save mode in which printing is performed by reducing the ejection amount from the nozzle 113 corresponding to the liquid having a small remaining amount is possible. Thus, it is possible to reduce a difference of the remaining amount between the plural kinds of liquids contained in the second liquid containers 118.

(7) When the replacement mode is selected without selecting the monochrome mode or the continuation mode even once, the control portion 123 does not perform discharge of the liquid by the discharge mechanism 122 after the second liquid container 118 is replaced. When there is a record in which the monochrome mode or the continuation mode is selected before the replacement mode is selected, the control portion 123 performs discharge of the liquid by the discharge mechanism 122 after the second liquid container 118 is replaced. If such an operation is performed, a timing at which the liquid is forcibly discharged by the discharge mechanism 122 when the second liquid container 118 is replaced is short. Thus, it is possible to reduce consumption of the liquid. Thus, it is possible to perform printing for a long term.

(8) The control portion 123 increases strength of discharging the liquid by the discharge mechanism 122, which is performed after the second liquid container 118 is replaced, as time elapsed after the monochrome mode or the continuation mode is selected becomes longer. As the time elapsed after the monochrome mode or the continuation mode is selected becomes longer, thickening and solidification of the liquid in the nozzle 113 which is not used for printing are accelerated. Therefore, it is possible to effectively discharge the liquid in the nozzle 113 by increasing the strength of discharge of the discharge mechanism 122 in accordance with the elapsed time.

(9) When the remaining amounts of all the plural kinds of liquids contained in the second liquid containers 118 are smaller than the first threshold, the control portion 123 sets in a state where selection of the replacement mode or the monochrome mode is possible. Thus, even when the remaining amounts of all the plural kinds of liquids contained in the second liquid containers 118 are smaller than the first threshold, it is possible to continue printing by selecting the monochrome mode.

The second embodiment can be changed as follows and be implemented. The second embodiment and the following modification example can be performed in combination thereof in a range without technically conflicting.

When the second liquid container 118 is replaced in a state of no flag, the liquid may be forcibly discharged from the nozzle 113 by the discharge mechanism 122 after the second liquid container 118 is replaced.

When the second liquid container 118 is replaced in a state of no flag, and the second liquid container 118 is not replaced within a defined period after the replacement mode is selected, the liquid may be discharged by the discharge mechanism 122. The reason is that thickening and solidification of the liquid are accelerated during a period until the second liquid container 118 is replaced. Therefore, as time from when the replacement mode is selected until the second liquid container 118 is replaced becomes longer, the strength of discharging the liquid by the discharge mechanism 122 may be increased.

The second liquid container 118 mounted in the second mounting portion 119 may have two storage chambers 128 or may have four or more storage chambers.

The number of nozzle rows 131 in the head 124 may be two, three, or five or more.

The number of nozzles 113 constituting the nozzle row 131 may be different from each other.

The discharge mechanism 122 may be a pump that pressurizes the liquid in the head 124. The liquid is forcibly discharged from the nozzle 113 by pressurizing the liquid in the head 124. As described above, forcible discharge of the liquid from the nozzle 113 by pressurization is referred to as pressurized cleaning.

A plurality of caps 121 may be provided for each nozzle row 131. In this case, it is possible to perform suction cleaning for each nozzle row 131.

The liquid ejecting portions 14 and 114 are not limited to a serial type in which the heads 24 and 124 are capable of moving in the main scanning direction X and may be a line type in which the heads 24 and 124 are long in the main scanning direction X.

The liquid ejected by the heads 24 and 124 is not limited to the ink and may be, for example, a liquid material in which particles of a functional material are dispersed or mixed in a liquid. For example, the heads 24 and 124 may eject a liquid material including a form in which a material such as an electrode material or a coloring material (pixel material), which is used for manufacturing a liquid crystal display, an electroluminescence (EL) display, and a surface emitting display is dispersed or dissolved.

Technical ideas grasped from the embodiments and the modification examples described above, and actions and advantageous effects thereof will be described below.

Idea 1

A liquid ejecting apparatus including: a liquid ejecting portion that performs printing by ejecting a liquid to a medium from a plurality of nozzles, a first mounting portion that is configured to mount a first liquid container that contains the liquid, a second mounting portion that is configured to mount a second liquid container having a liquid containing amount smaller than a liquid containing amount of the first liquid container, a detecting portion that detects a remaining amount of the liquid contained in the first liquid container mounted in the first mounting portion, and a control portion that calculates a remaining amount of the liquid contained in the second liquid container, based on a standard value representing an amount of the liquid contained in the second liquid container and a standard value representing an ejection amount of the liquid ejected from the liquid ejecting portion.

When the remaining amount of the liquid contained in the liquid container is calculated based on the standard value representing the amount of the liquid contained in the liquid container and the standard value representing the ejection amount of the liquid ejected from the liquid ejecting portion, an error between the calculated remaining amount of the liquid and the practical remaining amount of the liquid increases as the liquid containing amount by the liquid container increases.

According to this configuration, the detecting portion detects the remaining amount of the liquid contained in the first liquid container having a relatively large liquid containing amount. It is possible to recognize the remaining amount of the liquid in the first liquid container by the detecting portion. According to this configuration, the control portion calculates the remaining amount of the liquid contained in the second liquid container having a relatively small liquid containing amount, based on the standard value representing the amount of the liquid contained in the second liquid container and the standard value representing the ejection amount of the liquid ejected from the liquid ejecting portion. Since the liquid containing amount in the second liquid container is relatively small, a difference between the calculated remaining amount of the liquid and the practical remaining amount of the liquid is small. When the control portion calculates the remaining amount of the liquid in the second liquid container, it is possible to simplify the configuration in comparison to a case where the detecting portion detects the remaining amount of the liquid contained by the second liquid container. Thus, it is possible to reduce the error in the remaining amount of the liquid with a simple configuration.

Idea 2

In the liquid ejecting apparatus in Idea 1, the second mounting portion is configured to mount an integrated type second liquid container in which a plurality of the second liquid containers is integrally formed.

According to this configuration, it is possible to simplify the configuration of the second mounting portion in which the second liquid container is mounted.

Idea 3

In the liquid ejecting apparatus in Idea 2, the control portion controls the liquid ejecting portion to continuously perform printing until the remaining amount of the liquid contained in each of the plurality of the second liquid containers is smaller than a threshold.

The second liquid container mounted in the second mounting portion is set to an integrated type second liquid container in which a plurality of the second liquid containers is integrally formed. Therefore, when the second liquid container is replaced, all the second liquid containers are replaced together. At this time, in the plurality of second liquid containers, if the remaining amounts of the liquids have a difference, for example, in a case where the remaining amount of the liquid contained in one second liquid container is small, and the remaining amount of the liquid contained in another second liquid container is large, the liquid is easily wasted when the second liquid containers are replaced.

According to the configuration, since printing can be continuously performed by the liquid ejecting portion until the remaining amounts of all the liquids respectively contained in the plurality of second liquid containers are smaller than the threshold, it is possible to reduce waste of the liquid when the second liquid container is replaced.

Idea 4

In the liquid ejecting apparatus in Idea 1, a plurality of second mounting portions is provided.

According to this configuration, it is possible to separately replace the plurality of second liquid containers which is respectively mounted in the plurality of second mounting portions.

Idea 5

In the liquid ejecting apparatus in Idea 4, the second mounting portion is configured to mount the second liquid container including a porous member provided in a storage chamber that contains the liquid.

According to this configuration, since the porous member absorbs the liquid, it is possible to hold the liquid in the storage chamber.

Idea 6

In the liquid ejecting apparatus in Idea 5, the control portion reduces the ejection amount of the liquid ejected, per unit time, by the liquid ejecting portion corresponding to the second liquid container, depending on that the remaining amount of the liquid contained in the second liquid container is reduced.

When the ejection amount of the liquid ejecting portion is large, the liquid is strongly sucked from the storage chamber of the second liquid container including the porous member. At this time, if the remaining amount of the liquid contained by the second liquid container is small, an air may be supplied from the second liquid container into the liquid ejecting portion. From this point, according to the configuration, since the ejection amount of the liquid ejecting portion corresponding to the second liquid container having a small remaining amount is reduced depending on that the remaining amount of the liquid contained in the second liquid container is small, it is possible to reduce a concern of a supply of the air into the liquid ejecting portion.

Idea 7

In the liquid ejecting apparatus in any one of Idea 1 to Idea 6, the number of the nozzles corresponding to one second liquid container is smaller than a number of the nozzles corresponding to the first liquid container.

According to this configuration, since it is possible to reduce the ejection amount of the liquid contained in the second liquid container having a relatively small containment amount, it is possible to perform printing for a long term.

Idea 8

In the liquid ejecting apparatus in any one of Idea 1 to Idea 7, when the remaining amount of the liquid contained in the second liquid container is smaller than a threshold, the control portion sets in a state where performing a monochrome mode is possible, the monochrome mode in which not the liquid is ejected from the nozzle corresponding to the second liquid container, but the liquid is ejected from the nozzle corresponding to the first liquid container.

According to this configuration, since the liquid contained in the first liquid container is used instead of the liquid of which the remaining amount is small and which is contained by the second liquid container, it is possible to perform printing for a long term without replacing the second liquid container.

Idea 9

In the liquid ejecting apparatus in any one of Idea 1 to Idea 8, the control portion is configured to calculate the remaining amount of the liquid contained in the first liquid container based on a standard value representing the amount of the liquid contained in the first liquid container and a standard value representing the ejection amount of the liquid ejected from the liquid ejecting portion, and compares the calculated remaining amount of the liquid contained in the first liquid container and a detected remaining amount of the liquid contained in the first liquid container, to each other, and corrects a calculation result of the remaining amount of the liquid contained in the second liquid container based on the comparison, the detected remaining amount of the liquid being obtained from detection by the detecting portion.

According to this configuration, it is possible to reduce the error in the remaining amount of the liquid contained in the second liquid container.

Idea 10

A liquid ejecting apparatus including: a liquid ejecting portion that performs printing by ejecting a liquid to a medium from a plurality of nozzles, a first mounting portion that is configured to mount a first liquid container that contains the liquid, a second mounting portion that is configured to mount a second liquid container that contain plural kinds of liquids different from the liquid contained in the first liquid container, and a control portion that controls the liquid ejecting portion. The control portion has at least two modes of a replacement mode in which the second liquid container is replaced, a monochrome mode in which printing is performed with the liquid contained in the first liquid container, and a continuation mode in which printing continues without using the liquid having a remaining amount smaller than the first threshold among the plural kinds of liquids contained in the second liquid containers. The control portion sets in a state where selection of one of the modes is possible, when the remaining amount of at least one kind of liquid among the plural kinds of liquids contained in the second liquid containers is smaller than the first threshold.

The control portion has at least two modes of the three modes which are the replacement mode, the monochrome mode, and the continuation mode. Therefore, when the remaining amount of the liquid of at least one kind among the plural kinds of liquids contained in the second liquid containers is smaller than the first threshold, the monochrome mode or the continuation mode can be selected in addition to the replacement mode. When the monochrome mode is selected, printing can continue by using the liquid contained in the first liquid container. When the continuation mode is selected, printing can continue by using the liquids other than the liquid having a remaining amount which is smaller than the first threshold. According to the above configuration, even when the remaining amount of at least one kind of liquid among the plural kinds of liquids contained in the second liquid containers is smaller than the first threshold, it is possible to continue printing by using the liquid having a sufficient remaining amount. Accordingly, it is possible to continue printing.

Idea 11

In the liquid ejecting apparatus in Idea 10, when the monochrome mode or the continuation mode is selected, the control portion prohibits the nozzle corresponding to the liquid having a remaining amount which is smaller than the first threshold to eject the liquid relating to printing and is allowed to perform idle ejection which is ejection of a liquid having no relation with printing.

According to this configuration, since idle ejection is performed on the nozzle corresponding to the liquid having a remaining amount which is smaller than the first threshold among the plural kinds of liquids contained in the second liquid containers, it is possible to suppress thickening and solidification of the liquid in the nozzle which is not used for printing. Thus, it is possible to maintain ejection accuracy of the nozzle.

Idea 12

In the liquid ejecting apparatus in Idea 11, the control portion reduces the ejection amount of the liquid ejected in one idle ejection, depending on that the remaining amount of the liquid having a remaining amount smaller than the first threshold is small.

According to this configuration, when idle ejection is performed, it is possible to reduce consumption of the liquid having a remaining amount which is smaller than the first threshold among the plural kinds of liquids contained in the second liquid containers. Thus, it is possible to perform printing for a long term.

Idea 13

The liquid ejecting apparatus in Idea 11 or Idea 12 further including a cap capable of forming a closed space to which the nozzle opens. When the control portion performs the idle ejection in the cap before the closed space is formed after the monochrome mode or the continuation mode is selected, the control portion sets the ejection amount when the liquid having a remaining amount which is smaller than the first threshold among the plural kinds of liquids contained in the second liquid containers is ejected from the nozzle, to be smaller than the ejection amount when the liquids other than the liquids having the remaining amount which is smaller than the first threshold among the plural kinds of liquids contained in the second liquid containers are ejected from the nozzles.

According to this configuration, if the cap in which idle ejection has been performed forms the closed space, the nozzle is moisturized by the liquid in the cap. When idle ejection is performed in the cap, since the ejection amount of the liquid having a remaining amount which is smaller than the first threshold among the plural kinds of liquids contained in the second liquid containers is reduced, it is possible to reduce consumption of the liquid. Thus, it is possible to perform printing for a long term.

Idea 14

In the liquid ejecting apparatus in any one of Idea 11 to Idea 13, when the remaining amount of at least one kind of liquid among the plural kinds of liquids contained in the second liquid containers is smaller than the second threshold smaller than the first threshold, the control portion prohibits ejection of the liquid from the nozzle corresponding to the liquid having a remaining amount which is smaller than the second threshold among the plural kinds of liquids contained in the second liquid container.

According to this configuration, it is possible to reduce a concern of ejection an air from the nozzle corresponding to the liquid having a remaining amount which is smaller than the second threshold among the liquids contained in the second liquid container.

Idea 15

In the liquid ejecting apparatus in any of Idea 10 to Idea 14, when a difference between the remaining amount of one liquid among the plural kinds of liquids contained in the second liquid containers and the remaining amounts of other liquids is equal to or greater than a predetermined value, the control portion sets in a state where selection of a save mode in which printing is performed by reducing the ejection amount from the nozzle corresponding to the liquid having a small remaining amount is possible.

According to this configuration, it is possible to reduce a difference of the remaining amount between the plural kinds of liquids contained in the second liquid containers.

Idea 16

The liquid ejecting apparatus in any of Idea 10 to Idea 15 further includes a discharge mechanism that forcibly discharges the liquid from the nozzle. When the replacement mode is selected, the control portion does not perform discharge of the liquid by the discharge mechanism after the second liquid container is replaced. When the monochrome mode or the continuation mode is selected, the control portion performs discharge of the liquid by the discharge mechanism after the second liquid container is replaced.

According to this configuration, since a timing at which the liquid is forcibly discharged by the discharge mechanism is short, it is possible to reduce consumption of the liquid. Thus, it is possible to perform printing for a long term.

Idea 17

In the liquid ejecting apparatus in Idea 16, the control portion increases strength of discharging the liquid by the discharge mechanism, which is performed after the second liquid container is replaced, as time elapsed after the monochrome mode or the continuation mode is selected becomes longer.

As the time elapsed after the monochrome mode or the continuation mode is selected becomes longer, thickening and solidification of the liquid in the nozzle which is not used for printing are accelerated. According to this configuration, it is possible to effectively discharge the liquid in the nozzle by increasing the strength of discharge of the discharge mechanism in accordance with the elapsed time.

Idea 18

In the liquid ejecting apparatus in any of Idea 10 to Idea 17, when the remaining amounts of the plural kinds of liquids contained in the second liquid containers are smaller than the first threshold, the control portion sets in a state where selection of the replacement mode or the monochrome mode is possible.

According to this configuration, even when the remaining amounts of all the plural kinds of liquids contained in the second liquid containers are smaller than the first threshold, it is possible to continue printing by selecting the monochrome mode.

What is claimed is:

1. A liquid ejecting apparatus comprising:

a liquid ejecting portion that performs printing by ejecting a liquid to a medium from a plurality of nozzles;

a first mounting portion configured to mount a first liquid container that contains the liquid;

a second mounting portion that is configured to mount a second liquid container having a liquid containing amount smaller than a liquid containing amount of the first liquid container;

a detecting portion that detects a remaining amount of the liquid contained in the first liquid container mounted in the first mounting portion; and a control portion that calculates a remaining amount of the liquid contained in the second liquid container mounted in the second mounting portion, wherein the control portion determines that the remaining amount of the liquid contained in the first container becomes smaller than a threshold based on a detection result by the detecting portion, and that the remaining amount of the liquid contained in the second container becomes smaller than the threshold based on a calculation result by the control portion, wherein the calculation results of the liquid contained in the second liquid container are corrected based in part on the detection results of the liquid contained in the first liquid container by the detecting portion.

2. The liquid ejecting apparatus according to claim 1, wherein the second mounting portion is configured to mount an integrated type second liquid container in which a plurality of the second liquid containers is integrally formed.

3. The liquid ejecting apparatus according to claim 2, wherein the control portion controls the liquid ejecting portion to continuously perform printing until the remaining amount of the liquid contained in each of the plurality of second liquid containers is smaller than the threshold.

4. The liquid ejecting apparatus according to claim 1, wherein a plurality of the second mounting portions is provided.

5. The liquid ejecting apparatus according to claim 4, wherein the second mounting portion is configured to mount the second liquid container including a porous member provided in a storage chamber that contains the liquid.

6. The liquid ejecting apparatus according to claim 5, wherein the control portion reduces the ejection amount of the liquid ejected by the liquid ejecting portion, per unit of time, from the second liquid container, when the remaining amount of the liquid contained in the second liquid container is reduced.

7. The liquid ejecting apparatus according to claim 1, wherein the number of the nozzles corresponding to one second liquid container is smaller than the number of the nozzles corresponding to the first liquid container.

8. The liquid ejecting apparatus according to claim 1, wherein when the remaining amount of the liquid contained in the second liquid container is smaller than the threshold, the control portion causes a monochrome mode to be performed, wherein in the monochrome mode liquid is ejected from nozzles corresponding to the first liquid container but is not ejected from nozzles corresponding to the second liquid container.

9. The liquid ejecting apparatus according to claim 1, wherein the control portion is configured to calculate the remaining amount of the liquid contained in the first liquid container based on a standard value representing the amount of the liquid contained in the first liquid container and a standard value representing the ejection amount of the liquid ejected from the liquid ejecting portion, and the control portion compares the calculated remaining amount of the liquid contained in the first liquid container and the detected remaining amount of the liquid contained in the first liquid container, to each other, and corrects the calculation results of the remaining amount of the liquid contained in the second liquid container based on the comparison, the detected remaining amount of the liquid being obtained from detection by the detecting portion.

10. The liquid ejecting apparatus according to claim 1, wherein the control portion calculates the remaining amount of the liquid contained in the second liquid container based on a standard value representing the amount of the liquid contained in the second liquid container and a standard value representing the ejection amount of the liquid ejected from the liquid ejecting portion.

11. The liquid ejecting apparatus according to claim 10, wherein the detecting portion detects the remaining amount of the liquid contained in the first liquid container by transmitting light into an interior of the first liquid container and then reading.

12. The liquid ejecting apparatus according to claim 10, wherein the detecting portion includes an electrode.

13. A liquid ejecting apparatus comprising:

a liquid ejecting portion that performs printing by ejecting a liquid to a medium from a plurality of nozzles;

a first mounting portion that is configured to mount a first liquid container that contains the liquid;

a second mounting portion that is configured to mount a second liquid container having a liquid containing amount smaller than a liquid containing amount of the first liquid container;

a detecting portion that detects a remaining amount of the liquid contained in the first liquid container mounted in the first mounting portion; and a control portion that calculates a remaining amount of the liquid contained in the second liquid container, based on a standard value representing an amount of the liquid contained in the second liquid container and a standard value representing an ejection amount of the liquid ejected from the liquid ejecting portion, wherein the control portion is configured to calculate the remaining amount of the liquid contained in the first liquid container based on a standard value representing the amount of the liquid contained in the first liquid container and a standard value representing the ejection amount of the liquid ejected from the liquid ejecting portion, and wherein the control portion compares the calculated remaining amount of the liquid contained in the first liquid container and the detected remaining amount of the liquid contained in the first liquid container, to each other, and corrects a calculation result of the remaining amount of the liquid contained in the second liquid container based on the comparison, the detected remaining amount of the liquid being obtained from detection by the detecting portion.

* * * * *